US012157031B2

(12) United States Patent
Frank

(10) Patent No.: US 12,157,031 B2
(45) Date of Patent: Dec. 3, 2024

(54) EXERCISE TREADMILL

(71) Applicant: Runway Treadmill, LLC, Deerfield, IL (US)

(72) Inventor: Jordan Frank, Providence, RI (US)

(73) Assignee: Runway Treadmill, LLC, Deerfield, IL (US)

( * ) Notice: Subject to any disclaimer, the term of this patent is extended or adjusted under 35 U.S.C. 154(b) by 0 days.

(21) Appl. No.: 18/601,846

(22) Filed: Mar. 11, 2024

(65) Prior Publication Data

US 2024/0207674 A1 Jun. 27, 2024

Related U.S. Application Data

(60) Division of application No. 17/314,575, filed on May 7, 2021, now Pat. No. 11,951,351, which is a (Continued)

(51) Int. Cl.
*A63B 22/02* (2006.01)
*A63B 21/00* (2006.01)
(Continued)

(52) U.S. Cl.
CPC ..... *A63B 22/025* (2015.10); *A63B 21/4035* (2015.10); *A63B 24/0087* (2013.01);
(Continued)

(58) Field of Classification Search
CPC ..... A63B 22/025; A63B 71/0054; A63B 21/4035; A63B 24/0087; A63B 2225/74;
(Continued)

(56) References Cited

U.S. PATENT DOCUMENTS 124,938 A * 3/1872 Dane, Jr. ..... F16H 27/04 72/440
147,369 A * 2/1874 Burlan ..... A61C 5/77 433/200.1

(Continued)

FOREIGN PATENT DOCUMENTS

CA 3010980 5/2023
CA 3193860 10/2023

(Continued)

OTHER PUBLICATIONS

Crow, S., U.S. Appl. No. 15/350,240, Notice of Allowance, Apr. 24, 2019, 9 pages.

(Continued)

*Primary Examiner* — Garrett K Atkinson
(74) *Attorney, Agent, or Firm* — LaBatt, LLC

(57) ABSTRACT

An exercise treadmill is disclosed. The treadmill can include one or more sensors to acquire input data. A computer system can trigger one or more actions based on the input data. The input data can correspond to a lengthwise position of the user along a length of a usable surface of the platform and/or a lateral position of the user on the belt. The action(s) can include providing feedback to the user and/or adjusting rotation of the belt and/or a resistance of rotation of the belt. The adjustment can be performed in response to input from a user control requesting the adjustment.

18 Claims, 13 Drawing Sheets

Related U.S. Application Data continuation of application No. 16/448,653, filed on Jun. 21, 2019, now Pat. No. 11,000,728, which is a continuation of application No. 15/350,240, filed on Nov. 14, 2016, now Pat. No. 10,328,303.

(60) Provisional application No. 62/351,418, filed on Jun. 17, 2016, provisional application No. 62/329,354, filed on Apr. 29, 2016, provisional application No. 62/255,383, filed on Nov. 14, 2015.

(51) Int. Cl.

| | |
|---|---|
| ***A63B 21/005*** | (2006.01) |
| ***A63B 21/008*** | (2006.01) |
| ***A63B 22/00*** | (2006.01) |
| ***A63B 24/00*** | (2006.01) |
| ***A63B 69/00*** | (2006.01) |
| ***A63B 71/00*** | (2006.01) |
| ***A63B 71/06*** | (2006.01) |

(52) U.S. Cl.

CPC ..... *A63B 69/0057* (2013.01); *A63B 71/0054* (2013.01); *A63B 21/005* (2013.01); *A63B 21/008* (2013.01); *A63B 21/0085* (2013.01); *A63B 22/0023* (2013.01); *A63B 22/0285* (2013.01); *A63B 24/0059* (2013.01); *A63B 2024/009* (2013.01); *A63B 2024/0093* (2013.01); *A63B 2071/0063* (2013.01); *A63B 2071/0072* (2013.01); *A63B 2071/0081* (2013.01); *A63B 71/0622* (2013.01); *A63B 2071/0625* (2013.01); *A63B 2071/063* (2013.01); *A63B 2071/0647* (2013.01); *A63B 2071/0655* (2013.01); *A63B 2071/0658* (2013.01); *A63B 2071/0691* (2013.01); *A63B 2071/0694* (2013.01); *A63B 2220/13* (2013.01); *A63B 2220/18* (2013.01); *A63B 2220/22* (2013.01); *A63B 2220/30* (2013.01); *A63B 2220/40* (2013.01); *A63B 2220/53* (2013.01); *A63B 2220/56* (2013.01); *A63B 2220/803* (2013.01); *A63B 2220/805* (2013.01); *A63B 2225/09* (2013.01); *A63B 2225/093* (2013.01); *A63B 2225/50* (2013.01); *A63B 2225/682* (2013.01); *A63B 2225/685* (2013.01); *A63B 2225/74* (2020.08); *A63B 2230/04* (2013.01); *A63B 2230/06* (2013.01); *A63B 2230/062* (2013.01); *A63B 2230/207* (2013.01); *A63B 2230/208* (2013.01); *A63B 2230/42* (2013.01); *A63B 2230/50* (2013.01); *A63B 2230/505* (2013.01); *A63B 2230/75* (2013.01)

(58) Field of Classification Search

CPC ..... A63B 2230/208; A63B 2230/505; A63B 21/005; A63B 21/008; A63B 21/0085; A63B 22/0023; A63B 24/0059; A63B 2024/009; A63B 2071/0072; A63B 2071/0081; A63B 2071/0658; A63B 2071/0694; A63B 2220/53; A63B 2220/805; A63B 2225/09; A63B 2225/093; A63B 2225/685; A63B 2230/062; A63B 69/0057; A63B 2071/0625; A63B 2071/063; A63B 2071/0647; A63B 2071/0655; A63B 2220/13; A63B 2220/18; A63B 2220/30; A63B 2220/40; A63B 2220/803; A63B 2230/75; A63B 2071/0063; A63B 2220/56; A63B 2225/682; A63B 2230/06; A63B 22/0285; A63B 71/0622; A63B 2024/0093; A63B 2071/0691; A63B 2220/22; A63B 2225/50; A63B 2230/04; A63B 2230/207; A63B 2230/42; A63B 2230/50

See application file for complete search history.

(56) References Cited

U.S. PATENT DOCUMENTS

| | | | | | |
|---|---|---|---|---|---|
| 173,652 | A * | 2/1876 | Lightsinger, Jr. | G10D 7/14 | 84/377 |
| 246,746 | A * | 9/1881 | Gay et al. | B23B 31/1179 | 279/102 |
| 931,394 | A | 8/1909 | Day | | |
| 3,642,279 | A | 2/1972 | Cutter | | |
| 3,659,845 | A | 5/1972 | Quinton | | |
| 4,095,561 | A | 6/1978 | Ruetenik | | |
| 4,334,676 | A | 1/1982 | Schonenberger | | |
| 4,423,864 | A | 1/1984 | Wilk | | |
| 4,708,337 | A | 11/1987 | Shyu | | |
| 5,036,478 | A | 7/1991 | MacDougall | | |
| 5,088,729 | A | 2/1992 | Dalebout | | |
| 5,100,127 | A | 3/1992 | Melnick et al. | | |
| 5,104,119 | A | 4/1992 | Lynch | | |
| 5,279,528 | A | 1/1994 | Dalebout et al. | | |
| 5,314,391 | A * | 5/1994 | Potash | A63B 22/0023 | 73/379.06 |
| 5,368,532 | A * | 11/1994 | Farnet | A63B 22/02 | 482/54 |
| 5,476,429 | A * | 12/1995 | Bigelow | A63B 21/0056 | 482/904 |
| 5,649,882 | A | 7/1997 | Parikh et al. | | |
| 5,690,587 | A * | 11/1997 | Gruenangerl | A63B 22/02 | 482/54 |
| 5,800,314 | A * | 9/1998 | Sakakibara | A63B 22/02 | 482/3 |
| 5,827,155 | A | 10/1998 | Jensen et al. | | |
| 6,135,924 | A * | 10/2000 | Gibbs | A63B 22/02 | 482/54 |
| 6,390,955 | B1 | 5/2002 | Wang et al. | | |
| 6,676,569 | B1 | 1/2004 | Radow | | |
| 6,685,599 | B2 | 2/2004 | Wang et al. | | |
| 6,719,667 | B2 | 4/2004 | Wong et al. | | |
| 6,719,668 | B1 | 4/2004 | Huang | | |
| 6,733,423 | B1 | 5/2004 | Chang | | |
| 6,786,852 | B2 | 9/2004 | Watterson et al. | | |
| 6,860,839 | B1 | 3/2005 | Dice et al. | | |
| 7,066,865 | B2 | 7/2006 | Radow | | |
| 7,101,319 | B1 * | 9/2006 | Potts | A63B 22/0257 | 482/8 |
| 7,192,388 | B2 | 3/2007 | Dalebout et al. | | |
| 7,608,015 | B2 | 10/2009 | Radow | | |
| 8,007,407 | B2 | 8/2011 | Richter | | |
| 8,007,408 | B1 * | 8/2011 | Moran | A63B 22/0023 | 482/54 |
| 8,394,002 | B2 * | 3/2013 | Park | H02P 3/18 | 482/7 |
| 8,480,541 | B1 * | 7/2013 | Brunts | A63B 22/025 | 482/7 |
| 8,667,622 | B2 | 3/2014 | Truman et al. | | |
| 8,905,899 | B2 | 12/2014 | Hansen | | |
| 9,039,580 | B1 * | 5/2015 | Bayerlein | A63B 22/0017 | 482/54 |
| 9,364,714 | B2 | 6/2016 | Koduri et al. | | |
| 9,808,672 | B2 * | 11/2017 | Dalebout | A63B 21/225 | |
| 9,943,722 | B2 * | 4/2018 | Dalebout | A63B 24/0087 | |
| 9,950,213 | B2 * | 4/2018 | Skulman | A63B 24/0075 | |
| 10,328,303 | B2 * | 6/2019 | Frank | A63B 71/0054 | |
| 10,556,168 | B2 * | 2/2020 | Fima | A63B 24/0087 | |
| 11,000,728 | B2 | 5/2021 | Frank | | |
| 2003/0134717 | A1 | 7/2003 | Wang et al. | | |
| 2004/0038778 | A1 | 2/2004 | Kuo | | |
| 2004/0147369 | A1 * | 7/2004 | Jimenez Laso | A63B 22/025 | 482/8 |
| 2005/0075219 | A1 | 4/2005 | Choy | | |

(56) References Cited

U.S. PATENT DOCUMENTS

| | | | | |
|---|---|---|---|---|
| 2005/0132977 | A1 | 6/2005 | Mitzel | |
| 2008/0058169 | A1 | 3/2008 | Fox | |
| 2009/0124938 | A1* | 5/2009 | Brunner | A63B 71/0622 600/595 |
| 2009/0176629 | A1* | 7/2009 | Yi | A63B 22/025 482/54 |
| 2009/0246746 | A1* | 10/2009 | Roerdink | A61H 3/00 434/255 |
| 2010/0160115 | A1 | 6/2010 | Morris et al. | |
| 2010/0261579 | A1 | 10/2010 | Rice | |
| 2011/0118086 | A1* | 5/2011 | Radow | A63B 21/00196 482/5 |
| 2012/0010048 | A1* | 1/2012 | Bayerlein | A63B 21/0054 482/54 |
| 2012/0108398 | A1 | 5/2012 | Lo | |
| 2013/0165297 | A1 | 6/2013 | Daly et al. | |
| 2013/0274067 | A1* | 10/2013 | Watterson | A63B 22/203 482/5 |
| 2013/0281241 | A1 | 10/2013 | Watterson et al. | |
| 2014/0024500 | A1 | 1/2014 | Watterson | |
| 2014/0066263 | A1* | 3/2014 | Huang | A63B 22/0242 482/54 |
| 2014/0213419 | A1* | 7/2014 | Bayerlein | A63B 22/0023 482/54 |
| 2015/0080181 | A1* | 3/2015 | Skulman | A63B 24/0075 482/3 |
| 2015/0173652 | A1* | 6/2015 | Brunner | A61B 5/112 482/7 |
| 2015/0174444 | A1 | 6/2015 | Murray et al. | |
| 2015/0258382 | A1 | 9/2015 | Nolan et al. | |
| 2017/0136289 | A1* | 5/2017 | Frank | A63B 21/4035 |
| 2018/0008856 | A1 | 1/2018 | Radow et al. | |
| 2018/0296157 | A1* | 10/2018 | Bleich | A61B 7/00 |
| 2018/0304120 | A1* | 10/2018 | Skulman | A63B 71/0622 |
| 2019/0168066 | A1* | 6/2019 | Yoo | A63B 22/02 |
| 2019/0217153 | A1 | 7/2019 | Bayerlein et al. | |
| 2020/0139189 | A1 | 5/2020 | Bayerlein et al. | |
| 2022/0111248 | A1 | 4/2022 | Frank | |

FOREIGN PATENT DOCUMENTS

| | | | |
|---|---|---|---|
| DE | 202004018633 | U1 | 7/2005 |
| DE | 202013104491 | U1 | 10/2013 |
| FR | 1565617 | A | 5/1969 |
| KR | 1020070081476 | A | 8/2007 |
| KR | 1020130095665 | A | 8/2013 |
| WO | 9620757 | A1 | 7/1996 |
| WO | 2013129733 | A1 | 9/2013 |

OTHER PUBLICATIONS

Crow, S., U.S. Appl. No. 15/350,240, Office Action 3, Jan. 2, 2019, 12 pages.
Richman, G., U.S. Appl. No. 15/350,240, Final Office Action1, Jul. 16, 2018, 13 pages.
Richman, G., U.S. Appl. No. 15/350,240, Office Action2, Feb. 1, 2018, 7 pages.
Richman, G., U.S. Appl. No. 15/350,240, Office Action1, Sep. 29, 2017, 23 pages.
International Application No. PCT/US2016/061754, International Search Report and Written Opinion, Feb. 17, 2017, 14 pages.
GE Healthcare, "CASE: Cardiac Assessment System for Exercise Testing," Accessed on Jun. 16, 2016, 6 pages.
Rossiter, W., "Tacx's new Magnum home trainer is a bike treadmill!," Aug. 21, 2016, 8 pages, http://www.bikeradar.com/road/news/article/tacx-magnum-trainer.
Smart Bike Trainers, "Tacx Introduces the Magnum, A Smart Treadmill/Bike Trainer," Sep. 7, 2016, 7 pages, https://www.smartbiketrainers.com/tacx-introduces-magnum-smart-tread.
Sole Treadmills, "New Sole F85 Treadmill," Accessed on Nov. 4, 2016, 2 pages. http://www.soletreadmills.com/Treadmills/f85-sole-treadmill.
TACX Magnum, "The Next Big Thing," Accessed Jun. 22, 2017, 10 pages, http://magnum.tacx.com/.
Technogym, "Artis-Run Treadmil," Accessed on Nov. 4, 2016, 6 pages. http://www.technogym.com/us/artis-run-treadmill.html.
Technogym, "Skill-Mill Connect," Accessed on Nov. 4, 2016, 5 pages, http://www.technogym.com/us/skillmill-connect.html.
Tread LS, "TreadDesk, treadmill desks," Accessed on Jun. 16, 2016, 1 page. http://www.treaddesk.com/products/treads/tread-Is/?query=category.eq.T . . .
Woodway, "bari-mill, I Am Here for Comfort, The Ultimate Medical Treadmill," Accessed on Nov. 4, 2016, 3 pages. http://www.woodway.com/products/bari-mill.
Atkins, Garrett K., U.S. Appl. No. 16/448,653, Notice of Allowance, Feb. 24, 2021, 6 pages.
Atkins, Garrett K., U.S. Appl. No. 16/448,653, Office Action, Oct. 5, 2020, 11 pages.
Canadian Application No. 3010980, Office Action 1, Nov. 25, 2020, 4 pages.
Canadian Application No. 3010980, Notice of Allowance, Feb. 24, 2020, 1 page.
European Application No. 16865187.5, Extended Search Report, May 11, 2019, 15 pages, received Feb. 24, 2020.
European Application No. 16865187.5, Partial Search Report, Jun. 11, 2019, 15 pages, received Jul. 19, 2019.
Canadian Application No. 3010980, Notice of Allowance, Jun. 15, 2021, 1 page.
Canadian Application No. 3010980, Office Action, Sep. 28, 2022, 4 pages.
Office Action for European Application No. 16865187.5, Nov. 15, 2022, 7 pages.
Office Action for European Application No. 16865187.5, Jun. 29, 2023, 6 pages.
Notice of Allowance for Canadian Patent Application No. 3193860, Aug. 4, 2023, 1 page.
Ex Parte Quayle Action, U.S. Appl. No. 17/314,575, filed Jan. 8, 2024, 8 pages.
Notice of Allowance, U.S. Appl. No. 17/314,575, filed Feb. 9, 2024, 6 pages.
Canadian Application No. 3010980, Office Action, Feb. 22, 2022, 1 page.
Canadian Application No. 3010980, Notice of Allowance, Jan. 20, 2023, 1 page.
Office Action for European Application No. 16865187.5, Jan. 26, 2024, 6 pages.

* cited by examiner

EXERCISE TREADMILL

REFERENCE TO RELATED APPLICATIONS

The current application is a divisional of U.S. patent application Ser. No. 17/314,575, filed on 7 May 2021, which is a continuation of U.S. patent application Ser. No. 16/448,653, filed on 21 Jun. 2019, which is a continuation of U.S. patent application Ser. No. 15/350,240, filed on 14 Nov. 2016, which claims the benefit of U.S. Provisional Application No. 62/255,383, filed on 14 Nov. 2015, U.S. Provisional Application No. 62/329,354, filed on 29 Apr. 2016, and U.S. Provisional Application No. 62/351,418, filed on 17 Jun. 2016, each of which is hereby incorporated by reference.

TECHNICAL FIELD

The present invention pertains to the field of treadmills used for running, walking, and other exercise.

BACKGROUND ART

Treadmills are generally built with three main constraints: (1) A frontal rail generally including speed/incline controls; (2) a lack of side rails that extend meaningfully along the longitudinal axis of the treadmill; and (3) consistent belt speed set by the user—which may vary as the user shifts controls or an interval program occasionally (every 1+ minutes, perhaps) alters the speed. The aspects of the front rail and the need to use its controls cause the vast majority of runners to position themselves very close to the front rail to manage the controls, view the media console, and to ensure a sense of safety that they won't fall too far back to the center or rear of the treadmill where there are no supportive rails on one or both sides. The aspect of consistent belt speed also causes runners to drift as they constantly vary their pace, unconsciously favoring acceleration, to maintain a sense of security near the front of the treadmill. Positioned at the front rail, runners compromise form, efficiency and satisfaction. The frontal positioning of the control component and display including speed and distance ran/walked also becomes a visual focal point and distance counting distraction that's fundamentally different from an outdoor running experience.

Differences between over ground and treadmill running are easily observed once they are realized. This can be observed at any health club even with a small sample of runners. First, the observer will note that runners position their body very close to the front rail of the treadmill. From there, running differences can be observed vs. more natural outdoor running. Rather than letting shoulders and arms relax and move freely—with arms at about a 90 degree angle and hands practically brushing by the "pockets"—runners at the front rail of a treadmill cock their shoulders and position arms high and at a tight angle, like a boxer. Meanwhile, the media console is often between waist and chest high, far below the area that's anywhere from a point fifteen yards (e.g., fourteen meters) on the road ahead or the horizon line that runners should focus on for proper form. As a result of the constraints of current treadmill formats, runner's hip motion, footfall and stride must also be adversely affected by the lack of proper motion in his/her torso and upper body. Various research proves that out, having measured shorter strides and differences in ground reaction forces, for example.

Altogether, these factors resulting from the format of current treadmills challenge comfort, compromise form, and increase a likelihood of injury in a sport that already suffers from a high injury rate.

Various treadmills have been proposed and made which provide alternative softer treadmill surfaces to make them more comfortable. While these options may drive buying behavior, one must realize that the predominant running surface, the one for which running shoes are designed, is pavement. Meanwhile, treadmill manufacturers continue to do more to emphasize the front component, by adding media systems with entertainment and more programming options.

In other non-fitness treadmill categories, specialty treadmills include those designed for a treadmill desk application. These treadmills are generally shorter than running treadmills and have different motor types built for walking speeds up to about four miles per hour (MPH) or approximately 6.5 kilometers per hour. The TreadDesk™ product is one such example which also does not include any side-rails. Another approach indicates the aspects for desk mounting and safety in a treadmill walking scenario.

In the medical area, the GE CASE Exercise Testing System includes a treadmill that is designed to be used in conjunction with physiological monitors and a live operator who uses a remote monitor to monitor the patient and increase belt speed in order to push the patient to an 85% threshold or higher for a period of time sufficient for a stress test.

SUMMARY OF THE INVENTION

The inventor recognizes that a barrier to an improved treadmill experience is the influence the treadmill structure, particularly the front rail and its electronic component, has upon the user's form.

To this extent, the inventor recognizes a need for an exercise treadmill which: (1) provides features for positioning the user at or just forward from the lengthwise (longitudinal) center of the platform; (2) allows the user free motion, for example to swing arms and stride as he/she would normally on an unconstrained surface; (3) encourages eye positioning to favor an outward rather than downward or outward gaze; (4) provides a simpler means than pressing a button in a membrane control panel of adjusting speed and incline; and/or (4) provides constantly variable pacing controlled by the user's position. The present invention aims to address one or more of these issues and/or one or more other deficiencies of the prior art by, for example, providing a treadmill with no front rail, modified controls, physical accommodations of the treadmill structure, and/or sensor configurations, which provide one or more of the advantages described herein. Embodiments can provide a motor or leg powered/resistance moderated experience and/or a virtual reality experience, where the open ended and/or other traits designed to center the runner are advantageous to a virtualized running or walking experience.

A first aspect of the invention provides a treadmill comprising: a platform; a belt located around the platform; means for rotating the belt around the platform to create an endless surface on which a user exercises; a first side rail extending along at least approximately all of a first side of a usable area of a surface of the platform; a set of user controls positioned on the first side rail; and a front structure comprising a ramped surface, wherein the ramped surface covers a front non-usable area of the surface of the platform and is configured to direct a foot of the user onto the belt in response to a strike by the foot during use of the treadmill, and wherein the front structure is out of reach of the user while the user is exercising on the usable area of the surface of the platform.

A second aspect of the invention provides a treadmill comprising: a platform; a belt located around the platform; means for rotating the belt around the platform to create an endless surface on which a user exercises; a front structure comprising a ramped surface, wherein the ramped surface covers a front non-usable area of the surface of the platform and is configured to direct a foot of the user onto the belt in response to a strike by the foot during use of the treadmill, and wherein the front structure is out of reach of the user while the user is exercising on the usable area of the surface of the platform; means for detecting a lengthwise position of the user along a length of a usable surface of the platform; and means for dynamically adjusting rotation of the belt based on the lengthwise position of the user.

A third aspect of the invention provides a treadmill comprising: a platform; a belt located around the platform; means for rotating the belt around the platform to create an endless surface on which a user exercises, wherein the means for rotation includes a varying resistance device for dynamically adjusting a resistance of rotation of the belt, wherein the rotation of the belt is at least partially induced by the user exercising; and means for operating the varying resistance device to dynamically adjust the resistance of rotation of the belt based on a target speed of the user while exercising.

A fourth aspect of the invention provides a treadmill comprising: a platform; a belt located around the platform; means for rotating the belt around the platform to create an endless surface on which a user exercises; and means for providing feedback to the user regarding at least one of: a lengthwise position of the user on the platform or a lateral position of the user on the platform.

Without a front rail, a user may be more prone to run too far forward, beyond the usable surface of the treadmill. Inclusion of the structural ramped surface above the front roller can prevent the user from stepping over the front of the moving belt. The ramped surface can be designed to safely and smoothly return the foot back to the rolling belt. A similar ramp may be located at the rear of the treadmill.

In an embodiment, a treadmill described herein includes one or more side rails. A side rail can be configured to mount any combination of one or more of various objects, such as treadmill controls, motion and/or position sensors, accessories (e.g., a water bottle), a remote control for media or the treadmill itself, and/or the like. A side rail also can provide user safety regardless of the user's position on the treadmill. For example, the side rail can: (1) allow the user to grab the sidebars regardless of his/her longitudinal position along the belt and quickly move feet off the moving belt onto the side-area of the deck; (2) provide for the mounting of a stop button or pull string near the rear of the treadmill; and (3) include varying visual color, light, texture, slope, and/or the like, to provide the user a visual cue when he/she is drifting too far towards the back or front of the treadmill belt, helping the user to target his/her location at the longitudinal center of the treadmill deck.

Side rail height may be adjusted vertically and horizontally to suit the height of the user and activity performed, which can allow the user optimal ease of reaching the controls, e.g., at approximately elbow height. This adjustment can further align the rail height with the waist/trunk of the user, providing an ability to align longitudinal sensors built into the side rails with the waist/trunk height of the user.

Further attributes configured to provide feedback to the user about his/her longitudinal and/or lateral location can be implemented. For example, a surface under the belt can have varying texture and/or firmness. As a more particular example, the fore and aft portions of the treadmill's sub-belt surface may be softer or harder than the more central surface. The surface also can be ribbed in a manner that provides feedback to a user's foot but not create resistance to the spinning belt. Similar variations can be utilized with respect to the outer and inner lateral portions of the surface under the belt, e.g., to assist the runner in remaining in the center of the "path" of the belt.

The belt speed may be driven by an electronic motor, which can have an adjustable speed. In an embodiment, one or more aspects of the belt rotation can be dynamically adjusted based on a position of the user on the treadmill, a target performance of the user (e.g., physiological data, a target speed, etc.), and/or the like. For example, when the user is located too far forward on the platform, the electronic motor (e.g., under the direction of a computer system described herein) can dynamically increase the belt speed. Conversely, when the user is located too far to the rear of the platform, the electronic motor can dynamically reduce the belt speed.

Alternatively, the belt rotation can be at least partially powered by motion of the user (e.g., movement of the user's legs). In this case, the belt speed can be restrained by a variable resistance device. In typical resistance-based treadmills, the user dials in a set resistance and then starts running, generally with an incline required to overcome the resistance required to increase belt speed. Many such treadmills have a baseline incline of 8% grade and go up. However, for a user at a given weight and incline, the same amount of energy increases the belt speed equally regardless of the current belt speed, so that it is difficult to establish a fixed speed at a fixed resistance and incline. This can be seen in videos of users on products like the Shred-Mill—where professional athletes can only last for a 30 second to a minute interval.

In order to solve this problem, embodiments of a resistance device described herein can have a companion dynamic electronic program (e.g., executing on a computer system described herein), which can vary the resistance dynamically in order to, for example, help the user achieve and maintain a target speed (e.g., which can be an input by the user) and/or remain within a target area on the platform of the treadmill. The resistance device can comprise an electronic magnetic resistance device found frequently in cycling trainers, or it could be mechanically managed by air or water, similar to rowing machines which use these techniques. In the case of the resistance device, it can adjust resistance based on the percent incline and/or weight of the user. Given a slight incline, it could retain a user in standing position but start moving readily when he/she takes a first step. The dynamic program may even start the user at a slight incline, until he/she achieves a goal speed, and then reduce the incline towards a zero percent grade while also managing the resistance. Furthermore, the variable resistance device can be operated to add no resistance as the user is starting to move, and increase resistance as the user approaches or exceeds a target speed. As the user varies his/her energy input to the belt, the resistance program can dynamically alter the resistance to help maintain target speed, providing a subtle variation in the running effort as you may experience outdoors while going up and down hills. In this way, a flat decked treadmill (as opposed to a curved treadmill deck) may be able to facilitate a comfortable and natural leg powered experience.

Any speed, incline, exercise program (e.g. intervals), media controls, sensors and feedback monitors may be built into and/or onto the side rails. As compared to a front rail positioning, this configuration puts the controls closer to the user's body and arms while the user is running near the longitudinal center of the treadmill. As a result, the user would not need to reach to the front rail, causing them to belly up to, and remain, in the frontal area.

Controls in the side rails may be composed of electronic buttons, manual dials, manual levers, joystick style controllers, touch screens, and/or voice input mechanisms. This unique configuration has the effect of allowing the user to operate the treadmill without breaking running form, and without even looking at the controls so his/her gaze remains outwards, where it is focused in outdoor running. Due to user motion and sweaty hands, the manual dial and lever controls are easier for users to control during exercise than +/− electronic buttons or touch screens. In an effort to prevent the user from looking down at the rails to verify his/her speed/incline adjustments, click action and audio feedback can be built into the dial, lever and joystick mechanisms as the controls are modified.

Heart rate and/or other physiological sensors also can be built into the side rails where a user may easily place his/her hands for brief periods without greatly compromising running form. Alternatively, the treadmill may include a mechanism for acquiring heart rate and/or other sensor feedback via wireless communication.

Controls and monitor/feedback devices (indicating speed, time, incline) in the side rails may be mounted in-line, at a radial angle to the rail, or at a slanted angle to the rail to suit better ergonomics. A monitor may be mounted near the front of the side rails where it is easily visible, rather than next to the controls, which can be mounted near the lateral center of the side rails where they are easily operated by the user. Therefore, the controls are positioned where they are best for the user, near the longitudinal center, while the monitor(s) can be positioned further up but also off to the side so that counting miles doesn't become the sole and central focus for the user.

Sensors positioned on the treadmill, such as in the deck, side rails, and/or a front or back structure, may gauge the user's position for the purpose of auto-adjusting speed dynamically as the user goes faster or slower. An illustrative sensor configuration includes an electronic device emitting a beam of light focused laterally to a reflector mounted on the opposite rail. Light sensors beaming across the side rails can gauge the position of the user's waist/trunk. Tripping sensors closer to the center of the treadmill may cause small adjustments in speed while tripping sensors near the forward and rear ends of the rail system may cause faster speed adjustments. Furthermore, the sensor data can be processed by a computer system which responds variably to sensor input depending on whether the interruption is momentary, a short interruption or a continuous interruption. Momentary interruptions could be an arm or leg swing with no affect. A short interruption can cause a fixed change in speed while an obstruction may trigger a continuous change in belt speed until the obstruction is cleared. Both waist positioning and footfall should be relatively consistent so they will be readily usable to trigger gradual changes in the motor speed or resistance level when the user travels too far to the forward or rear portion of the treadmill belt.

A longer interruption of the sensor may cause a change in speed that increases more rapidly over time rather than continuously—up to the speed at which the treadmill motor can be responsive. This feature can be especially useful in startup, during the beginning of an interval, or when the user wants to slow down quickly.

A sensor or set of sensors may be mounted closer to the rear of the treadmill which would cause a very rapid decrease in speed or move the belt to a safe stop as quickly as possible. Additional sensors also can collect feedback on lateral position, stride length, cadence, duration foot remains on treadmill deck, weight of the user, downward pressure of each foot strike, relative position of foot strike compared to user's upper body, and/or the like.

ANT+ or similar wireless sensors built into the treadmill deck or rails may pick up sensor and input data from the user. Sensor data may include heart rate, body temperature, blood oxygen levels, and other health data.

Wireless or wired input data may include instructions from the user, a computer, and/or a networked computer, to make changes to speed, resistance, incline or other aspects of the treadmill operation. For example, using information from the user, heart rate vs. heart rate goal may drive the speed of the belt or the resistance. Another example embodiment includes input received from another computer to simulate a running course, induce the user to keep up with another user on another treadmill, induce the user to exceed a previous performance, and/or the like.

In the case where heart rate or other physiological data (e.g., body temperature, blood oxygen levels, and/or the like) are collected to drive the speed of the treadmill belt, the belt speed may gradually increase until the goal value or value range is met. Once over the goal or goal value, the treadmill may work to maintain the user over the goal value or within the value range. The location sensors can work in concert with the physiologically driven input. For example, rear sensors can prevent a failing user from falling off the back if the user is pushed beyond a limit, and forward sensors can be used to increase speed according to the user's comfort but they can be ignored when the user has met the maximum range demanded by a stress test or interval program. The maximum can ensure that the user is capable of completing the interval or stress test. Such an embodiment can be particularly useful in evaluating the abilities of the user, such as in a medical environment, where the user is a patient, an athlete, and/or the like. Similarly, the embodiment can be particularly useful when the user, such as an athlete, is in training.

ANT+, Bluetooth, Wi-Fi or other wireless transmitter built into the treadmill deck or rails to communicate information on work out data to a treadmill mounted or portable device.

In the auto-adjusting scenario, the electronic motor or magnetic resistance device will speed up as the user moves towards the front and slow down as the user falls back past the center of the treadmill. In the electronic motor case, it may drive the belt at a particular speed as long as the user is longitudinally centered but slow down or speed up for safety if the user encroaches too far to the rear or front, respectively. The auto-adjusting may simply prevent the user from running off the front or back, or it may be used to enable natural variation of speed.

The treadmill base can include a flat surface or a pitched ramp at the front and/or the back of the treadmill platform, which can provide a safety element and that can further provide "tactile" feedback to the user to prevent him/her from going too far forward or backwards. The ramp(s) can have adequate structural support to handle an impact of a user's foot strike while striding past the roller. The ramp(s)

also can have a surface or surface mechanism adequate to allow the foot to slide back (front) to the roller or grip (back ramp) in order for the user to find his/her way back to the moving surface. The front ramp may be composed of a hard plastic, a metal, a hard plastic or hard rubber with longitudinal ridges, a field of ball bearings, thin lateral rollers or other suitable surfaces to allow the foot to move back to the moving surface after the user strides too far forward past the front of the moving surface.

A variation of the treadmill may facilitate a bicycle with the addition of a horizontal roller at a height of 1 to 4 inches (2 to 10 centimeters) above the front and back of the treadmill deck, or a set of horizontal lateral rollers built into the ramp. The rollers would allow the bicyclist to roll towards the front or back and continue pedaling without riding off the deck. Such a variation may also include a pivot for the side-rails to narrow the left-right motion of the rider such that he/she cannot veer off the belt while riding.

A variation of the treadmill may be wider or have other belt size differences to accommodate other sports such as roller-blading or cross-country skiing on wheels.

A projector may be mounted in the treadmill base front or the front area of the side deck or on the side rails to project media and user feedback towards a wall in front of the user.

An embodiment of the treadmill can work in conjunction with a virtual reality system to provide the user with a simulated immersive environment. In such a case, the treadmill can include beacons configured to interact with a virtual reality component, such as a headset and/or other accessories of the virtual reality system. The virtual reality sensor data, in combination with a virtualized map of the physical space of the treadmill belt and its rail(s), can be used to create a virtualized running or walking experience. Sensors located on the treadmill, such as in a side rail, belt, and/or platform, can augment the data captured by traditional virtual reality beacons, headset, and accessories, to simulate a more accurate and safe virtual reality experience.

Additional arms may fasten to the side rails or treadmill deck for a fixed or swing arm accessory capable of holding a media console/screen and/or speakers at the front end of the treadmill. Such a design can position the screen well ahead of the user's location on the belt and adjust to approximately eye level or slightly below, supporting an ergonomics which points the user's eye towards the "horizon" or just below.

The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

FIGS. 8A and 8B show basic programming logic for translating sensor feedback to increase according to an embodiment, while

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As used herein, unless otherwise noted, the term "set" means one or more (i.e., at least one) and the phrase "any solution" means any now known or later developed solution. It is understood that, unless otherwise specified, each value is approximate and each range of values included herein is inclusive of the end values defining the range. As used herein, unless otherwise noted, the term "approximately" is inclusive of values within +/− ten percent of the stated value, while the term "substantially" is inclusive of values within +/− five percent of the stated value. Unless otherwise stated, two values are "similar" when the smaller value is within +/− twenty-five percent of the larger value.

As indicated above, aspects of the invention are directed to an exercise treadmill. An embodiment of the treadmill includes no obstructing front or back rails within reach of the user while he/she is exercising on the treadmill. An embodiment of the treadmill can further include one or more side rails and/or other aspects configured to provide safety, ergonomics, and/or entertainment for the user.

Figure 1:
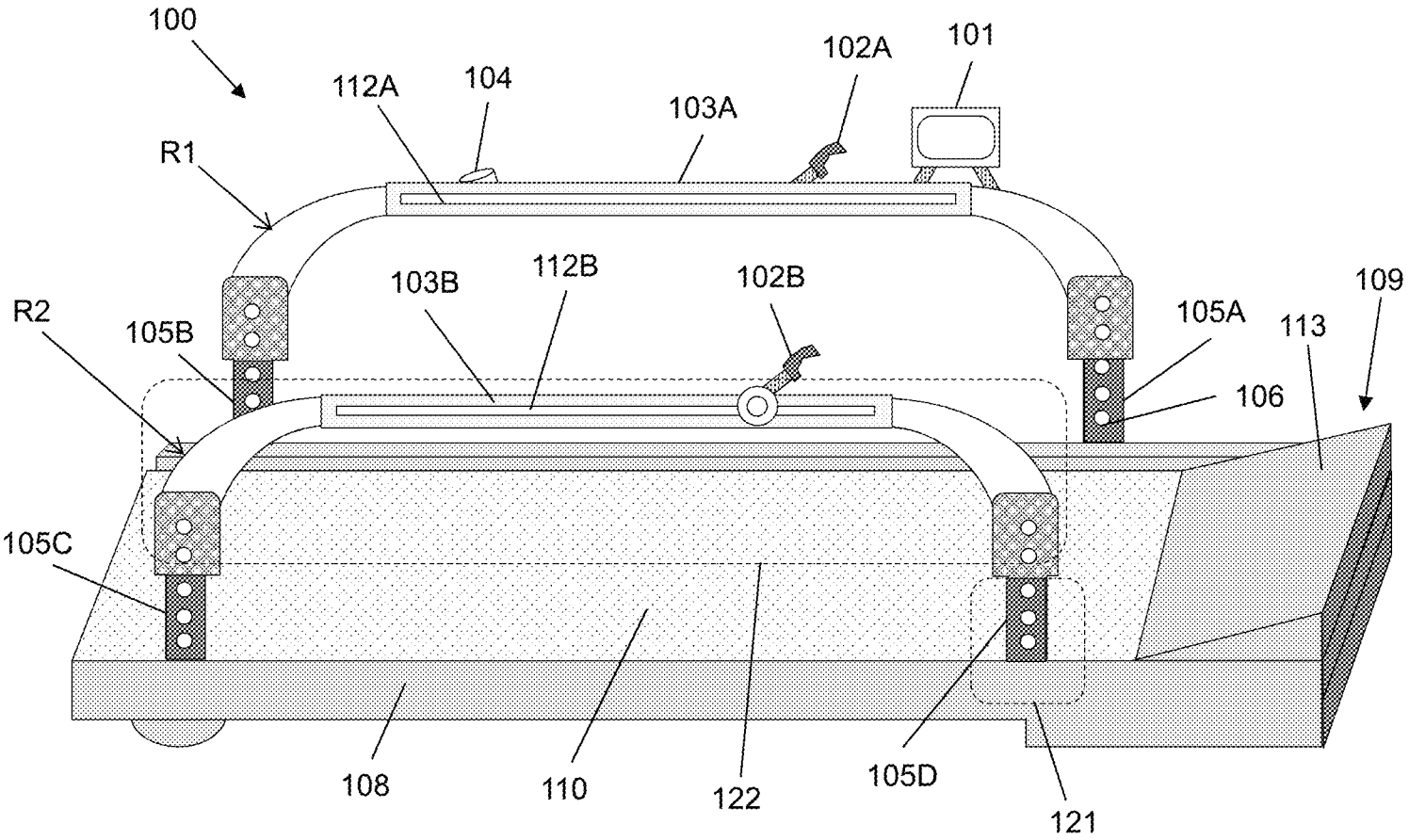
FIG. 1 shows an illustrative embodiment of a treadmill having no frontal control panel, side rails with accessory items, and a ramp over and extending in front of the front roller.

Turning to the drawings, FIG. 1 shows a side perspective view of an illustrative treadmill 100 according to an embodiment. As is known, the treadmill 100 can include a platform 108 and a belt 110 located around the platform 108. The belt 110 can be rotated around the platform 108 to create an endless surface on which a user can exercise (e.g., walk, run, and/or the like). An embodiment of the belt can include a plurality of parallel transverse slats oriented perpendicular to an axis of rotation of the belt. Embodiments of the treadmill 100 can enable an end of the platform 108 (e.g., the front end) to be raised and/or lowered to create a surface having any desired incline (or decline). The raising and lowering of an end of the platform 108 can be performed using any solution, such as the solutions utilized in conjunction with prior art treadmills.

The belt 110 can be rotated around the platform 108 using any solution. For example, the treadmill 100 can include one or more rollers, which allow for movement of the belt 110. To this extent, the treadmill 100 can include one or more rollers located on one or both ends of the platform 108. In this case, one or both rollers can be automatically driven by, for example, an electronic motor, which can be configured to rotate the belt 110 at any of numerous speeds. In an embodiment, the rotation of the belt 110 is at least partially driven by the motion (e.g., walking, running, or the like) of the user. In this case, the platform 108 can include a series of laterally oriented rollers located along a usable length of the platform 108, which rotate in response to the motion of the user, causing the belt 110 to rotate around the platform 108. Furthermore, the treadmill 100 can include a varying resistance device, which can be operated to provide a varying amount of resistance to the user's ability to rotate the belt 110 around the platform 108. The varying resistance device can comprise any type of varying resistance device, such as those utilized in such devices known in the prior art.

The treadmill 100 illustrates aspects of embodiments of the invention including, but not limited to, an absence of a frontally located control panel (common in prior art treadmills), and a redistribution of a set of user controls over a first rail R1 and/or a second rail R2. Each rail R1, R2 is shown extending along a corresponding side of the platform 108. As illustrated, each rail R1, R2 can extend along approximately all of usable area of the corresponding side of the platform 108. However, it is understood that embodiments of a rail R1, R2 can extend beyond the extent of the usable area in either or both directions or embodiments of the rails R1, R2 can extend over a smaller portion of the usable area of the platform 108. As defined herein, the usable area of the platform 108 comprises the lengthwise area of the platform 108 that provides a surface suitable for the intended activity (e.g., walking, running, and/or the like) on the belt 110 and does not include the furthest extent of the platform 108 (e.g., the furthest two inches or five centimeters) in either lengthwise direction and/or the furthest lateral extent of the belt 110 (e.g., the outermost two inches or five centimeters).

In example embodiments, the rails R1, R2 contain most or all of the user controls and indicators for a user of the treadmill 100. As discussed herein, the user controls can be further designed to be accessible to a user running on the treadmill 100 at a high pace, being exhausted, and not capable or willing to read or press small control buttons. As a result, in embodiments of the present invention, the user controls can be designed to be exceptionally user friendly and include large control units, controls strategically and/or optimally positioned on the rail R1 and/or the rail R2, and/or gesture units detecting user-based gestures and providing inputs to the treadmill 100, as explained herein.

For example, the treadmill 100 is shown including a monitor 101. The monitor 101 can comprise any type of media console, which can present audio and/or visual information to the user. The monitor 101 can be mounted on an arm, which places the monitor 101 sufficiently far from the user to as to not obstruct the user's arm motion. Furthermore, a height of the monitor 101 can be adjusted so that the user can view the monitor 101 at or below the "horizon" level, depending on a form preference and posture of the user. Alternatively, the monitor 101 can be mounted remotely from the treadmill 100, such as on a wall, or projected onto a wall, or the like. In an embodiment, the monitor 101 can comprise a touchscreen, be operable using a remote control, and/or include additional input buttons, which enable the user to adjust one or more settings for operation of the treadmill 100.

The monitor 101 can provide various types of information, such as information regarding one or more operating characteristics of the treadmill, information regarding the user (e.g., physiological information), information on a workout being performed by the user, and/or the like. Furthermore, the monitor 101 can present entertainment-related information to the user, such as a movie/television program, and/or the like. In an embodiment, the monitor 101 can present a video or animation that synchronizes with one or more operational settings of the treadmill 100. For example, the animation can provide a virtual course, with the speed of moving through the course synchronized with the speed of the treadmill and an inclination of the treadmill changing in synchronization with elevation changes on the course.

The treadmill 100 is further shown including a lever 102A positioned on the first rail R1, which can be utilized to adjust one or more settings of the treadmill 100, e.g., a speed with which the belt 110 is being rotated. The lever 102A can comprise a lever unit designed to move continuously or discretely to increment or decrement the corresponding setting, such as the speed of the belt 110 rotating around the platform 108 of the treadmill 100. In an embodiment, the lever unit can be allowed to pivot about a portion fixed to the first rail R1 and move up or down in a set of discrete positions to adjust the speed of the belt 110.

The treadmill 100 is further shown including a second lever 102B positioned on and/or coupled to the rail R2. The second lever 102B can allow for control of the same or distinct operational feature(s) of treadmill 100. In a non-limiting example, the lever 102B may control a distinct operational feature than the lever 102A, for example, the inclination of the platform 108. In another non-limiting example, the lever 102B may control the same operational feature(s) as the lever 102A. In the non-limiting example where both levers 102A, 102B control the same operational feature for treadmill 100 (e.g., belt speed), the user may utilize both or either lever 102A, 102B for adjusting the operational feature of the treadmill 100.

The user's decisions to use the lever 102A and/or the lever 102B may be based on personal preference, body position on the treadmill 100 and/or position of the lever 102A, 102B on the rails R1, R2, respectively. The lever 102B may be formed from a similar or distinct component as the lever 102A and/or may function or operate in a similar fashion as the lever 102A. Additionally, although shown as being substantially aligned with one another on the rails R1, R2, it is understood that the levers 102A, 102B may be located in distinct lengthwise positions staggered on the rails R1, R2. For example, the lever 102A can be positioned closer to one of the front or the back of treadmill 100 than the lever 102B.

Although lever units 102A, 102B are shown in FIG. 1, it is understood that a user control may be formed from a variety of suitable components configured to be adjusted and/or interacted with by a user to make one or more adjustments, e.g., control the speed of the belt 110, inclination of the platform 108, and/or the like. For example, in an embodiment, a speed and/or incline adjusting user control can comprise a "paddle shifter," which is configured to be operated by a user in a manner similar to a paddle shifter on a semi-automatic car transmission. The paddle shifter can comprise a lever that can be moved in a first direction (e.g., pushed up) to increase speed/incline, and moved in a second direction (e.g., pushed down) to decrease speed/incline. The paddle shifter returns to its original position after each movement action.

In another embodiment, a user control can comprise a joystick format control. In this case, the joystick format control can support movement in four directions and may allow for adjustments to multiple types of settings, such as speed and incline, to be made with a single control. For example, movement of the joystick forward/backward can result in an incremental increase/decrease of the speed, while movement of the joystick left/right can result in an incremental increase/decrease of the incline. In still another embodiment, a user control can comprise a wireless remote control, which can include any combination of buttons or other input devices for making one or more adjustments to operation of the treadmill or an ancillary component thereof (e.g., a monitor). Such a remote control can be worn on the user's body (e.g., a bracelet), be operated using speech (e.g., via an app executing on a smartphone), be attached to the user's clothing, include any combination of various input controls (e.g., one or more buttons, a joystick, and/or the like), etc. In an embodiment, a remote control can be held and/or worn on an arm/hand of the user, and can detect user commands via gestures made by the user, e.g., using data acquired by an accelerometer, an inertial and/or orientation sensor, and/or the like, included in the remote control.

Regardless, similar to other controls, a move and hold action performed on a user control described herein can allow the user to quickly adjust a setting through a range of incremental adjustments (e.g., speeds and/or inclines), before releasing at a desired setting (e.g., speed or incline). Information relating to a current setting of the treadmill 100, such as speed information relating to the belt 110, can be presented to the user using any solution, e.g., by being displayed on a monitor 101, as discussed herein.

Alternatively, or in addition to the levers 102A and/or 102B, operational features of treadmill 100, may be adjusted by user hand gestures. In a non-limiting example, panels 112A and 112B can be positioned on and/or within the rails R1 and R2, respectively, and may be configured to sense user hand gestures or actions (e.g., hand sliding) on the rails R1, R2 to adjust the speed up or down, alter the inclination up or down, and/or the like. The gestures can include hand sliding in a first direction along the rail (e.g., first rail R1) to increase the speed, and hand sliding in the opposite direction to decrease the speed. Similarly, additional gestures can include hand sliding in the first direction along the rail (e.g., second rail R2) to increase the inclination of the treadmill 100, and hand sliding in the opposite direction to decrease the inclination. Another gesture involves hand squeezing the rail, which can result in a corresponding adjustment. For example, squeezing the rail R1 may result in a quick decrease of the speed. It is understood that a wide variety of other gestures and corresponding adjustments can be employed for each of the rail R1 and R2 to alter the operation of the treadmill 100. Furthermore, it is understood that a gesture may require that the user perform a coordinated gesture with both hands (e.g., concurrent sliding or squeezing motions).

Apart from controlling the speed and inclination settings of a treadmill, user gestures can be used to adjust one or more operating aspects of a monitor (such as the monitor 101). To this extent, for the case of a monitor 101 having multiple audio-visual channels, or capable of operating in different regimes (for instance, one of the operational regime can be an entertainment regime, and one related to the information about user and treadmill performance), a user gesture can adjust the current operating regime. Alternatively, user gestures can be used to adjust the sound emitted from speakers associated with the monitor 101, to turn on and off a fan on the treadmill (for embodiments including a fan), and/or the like. The monitor 101 may be mounted on the treadmill 100 particularly for feedback about speed, incline, distance, calories burned and user input settings. A monitor 101 may also be mounted remotely or on a non-obstructing mount connected to the front of the treadmill 100.

The treadmill 1000 can include control units 103A and 103B of first rail R1 and second rail R2 that can contain, in addition to the panels 112A and 112B and/or levers 102A, 102B, additional input (e.g., buttons, touch screen, and/or the like) devices for processing user inputs. Additionally, the control units 103A and 103B may also house one or more sensors used to determine the lengthwise and/or lateral position of the user on the platform 108. For example, sensors positioned within the control units 103A and 103B may determine the potentially varying lengthwise position of the user on the platform 108 as the user is running on treadmill 100. The sensors within control units 103A and 103B can detect where the user's core body is positioned while he/she is using the treadmill 100. The control units 103A and 103B can use the position information as input to, for example, alter the speed of the belt 110. In non-limiting examples, the input based on the user's lengthwise position on the platform 108, as determined by the sensors of control units 103A and 103B, may be used to automatically reduce the speed of the belt 108 in response to determining that the user has approached the back of the platform 108 or may increase the speed of the belt 108 in response to determining that the user has approached the front of the platform 108.

The sensors of control units 103A and 103B may be any suitable sensors. For example, the sensors can include, but are not limited to, optical sensors, ultrasonic sensors, and/or other sensors configured to detect the lengthwise position of the user and provide input relating to the detection of the user's position on the treadmill 100. In another non-limiting example, the control unit 103A may include a plurality of emitting and detecting devices and the control unit 103B may include a set of corresponding reflective surfaces. In this case, each emitting device in control unit 103A may emit a signal (e.g., electromagnetic radiation) from the control unit 103A toward a corresponding reflective device positioned within control unit 103B. If the path of the signal is not blocked by the user, the signal will reach the reflective device and may be reflected from control unit 103B and back toward control unit 103A to be received and/or detected by a detection device in control unit 103A. Conversely, if the signal is blocked and/or interrupted by the user of the treadmill 100, the detection device of the control unit 103A may not receive the reflected signal and may produce data relating to the position of the user on the platform 108. Specifically, the control unit 103A may determine the position of the user on treadmill 100 by determining the number and/or position of detection devices of the control unit 103A that do not receive and/or detect the signal that is absorbed by the user and not reflected by the reflective device of control unit 103B.

The control units 103A, 103B also can include one or more sensors for detecting a lateral position of the user. For example, the control units 103A, 103B can include sensors that work in conjunction with sensors located on the user to measure a lateral distance between the user and the rails R1, R2. For example, a sensor on the user can be located on gloves worn by the user. In this case, the distance can be measured from the motion of the user's arms.

An embodiment of the control units 103A and 103B can house LED lighting strips. For example, such a strip can provide a visual signal (by color or by flashing) to the user in response to determining that the user has traveled too far forward or backward on the platform 108. The lighting strips of control unit 103A and 103B may be used as a stand alone warning system, or may be used in conjunction with the sensors formed in control unit 103A and 103B, as discussed herein. In a non-limiting example where the lighting strips of control unit 103A and 103B are an independent warning system, the lights strips may be constantly lit with varying colors, where the colors indicate a proximity to an end (e.g., front or back) of the usable area of the platform 108. For example, the lighting strips may be positioned along substantially the entire length of control unit 103A and 103B and from back to front may vary in color in the following order: red-yellow-green-yellow-red. When a user is aligned with the red lights of the light strip, the user may be approaching or be close to an end (e.g., front or back) of treadmill 110, and the yellow lit portion may indicate to a user that he has drifted forward or backward from the center of treadmill belt 110, which may be indicated by the green lit portion of the light strip.

In a non-limiting example where the lighting strips are used in conjunction with the sensors of control units 103A and 103B, the entire lighting strip may light a single color to notify or warn the user of his/her position on the platform 108. The lighting scheme may function in a similar manner as discussed herein. Specifically, when the sensors detect that a user is positioned in the lengthwise center of the platform 108, the lighting strips may illuminate green. However, if the sensors detect that the user drifts or moves too far forward or back from the central area of the platform 108, the strips may illuminate yellow or red, depending on the detected position of the user and/or the user's proximity to a longitudinal end (e.g., front or back) of the platform 108. In an embodiment, the rails R1, R2 can be configured to provide visual feedback regarding the lengthwise position of the user using one or more approaches, such as a changing slope with respect to the platform, a changing shape, a changing color, and/or the like.

In an embodiment, the monitor 101 can be worn by the user, rather than being mounted on the treadmill. In a more particular embodiment, the monitor 101 can comprise a virtual reality component, such as a headset, worn by the user. In this case, the monitor 101 can provide the user with a simulated immersive environment (e.g., a virtual reality environment). In this embodiment, the treadmill 100 can include a set of location devices, e.g., as part of the control units 103A, 103B, configured to interact with one or more components of a virtual reality system, which can include the virtual reality headset and/or other virtual reality accessories. For example, the control units 103A, 103B can include one or more infrared sensors and/or emitters (e.g., beacons), which can be mounted on the treadmill 100 (e.g., a rail of the treadmill). Each location device can provide location information utilized by the virtual reality system (e.g., processed by a computer system in the virtual reality headset) to determine the relative locations of the treadmill and the user. Any type of location device can be utilized, such as an infrared-based tracking sensor, which can detect infrared light emitted by the virtual reality headset. Regardless, the location device(s) can serve as a set of anchors for enabling a virtual reality mapping of the treadmill and to provide visual or auditory feedback to the user in the event the user moves too far forward or backward or to a lateral side of the platform. In this manner, the treadmill 100 can be utilized in conjunction with the virtual reality system to create a safe, immersive virtual environment for the user.

The treadmill 100 can include sensors and/or processing units for acquiring physiological data regarding the user using any solution. For example, the treadmill 100 can contain a processing unit for reading user biological signals (such as heart rate, blood pressure, breath rate, breath size, stride length, hand range, and torso movement) and processing these signals and/or displaying one or more of these signals on the monitor 101. The biological signals can be measured by auxiliary sensors attached to the user and communicating with a processing unit of the treadmill 100 through a wireless communications solution, such as the Bluetooth interface.

As shown in FIG. 1, the first rail R1 and second rail R2 can have adjustable heights. For example, the heights of the rails R1, R2 can be adjusted with adjustable mechanisms 105A-105D. The mechanisms 105A-105D can comprise a pin and rail having a pillar section 121 and a top rail section 122 where the top rail section 122 can be slid up or down into the pillar section 121. A range of heights for the rails R1, R2 can be controlled by a pin inserted into one of the holes 106. An alternative embodiment can utilize a knob to adjust the rail height using a screw mechanism. Regardless, it is understood that rail height adjustment can be implemented using any of various solutions available in the art. It is understood that first rail R1 and second rail R2 can have a duplicate of controls and monitors, or each rail can serve its own portion and have its own controls and monitors.

FIG. 1 also shows a front structure 109 located at a front of the treadmill 100. The front structure 109 can be included as a safety mechanism to prevent the user from moving too far forward on the platform 108. However, the front structure 109 can be configured so as to not interfere with the user's motion or vision while using the treadmill 100. To this extent, an embodiment of the front structure 109, which can include a media and/or control component, can be out of reach of the user while the user is exercising on the usable area of the surface of the platform 108.

In a more particular embodiment, the front structure 109 can have a height of no more than a knee of the user. In a still more particular embodiment, a height of the front structure 109 can be less than 18 inches or 45 centimeters above the surface of the platform 108. In another embodiment, any portion of the front structure that extends above the knee or waste of the user is located sufficiently forward from the usable area of the surface of the platform 108 so as to not be within reach of the user. For example, any such portion extending higher than 18 inches or 45 centimeters above the surface of the platform 108 can be located at least two feet or 61 centimeters forward from the usable area of the surface of the platform 108 and at least three feet or 90 centimeters forward in a more particular embodiment.

An embodiment of the front structure 109 can include a ramped surface 113. The ramped surface 113 can be located over and cover a front non-usable portion of the platform 108 (e.g., a front roller, which is not shown). The ramped surface 113 can be configured to provide a kick board, which prevents the user from tripping over the front of the moving belt 108 and/or for preventing the user from running off the front of the treadmill 100.

The front structure 109 can identify for the user the end of the treadmill 100, and specifically, the end of the platform 108. The front structure 109 may identify the end of treadmill 100 both visually and tactilely. For example, the user may see the front structure 109 (which can include visual markers, lights, and/or the like) and visually identify where the usable surface (e.g., exposed area of the platform 108) ends. Additionally, the user may also feel that he/she is leaving or approaching the end of the runnable surface when the user accidently kicks, runs and/or steps on the ramped surface 113. To this extent, the ramped surface 113 can be made from a distinct material and/or have unique properties and attributes when compared to other portions of treadmill 100.

Figure 2:
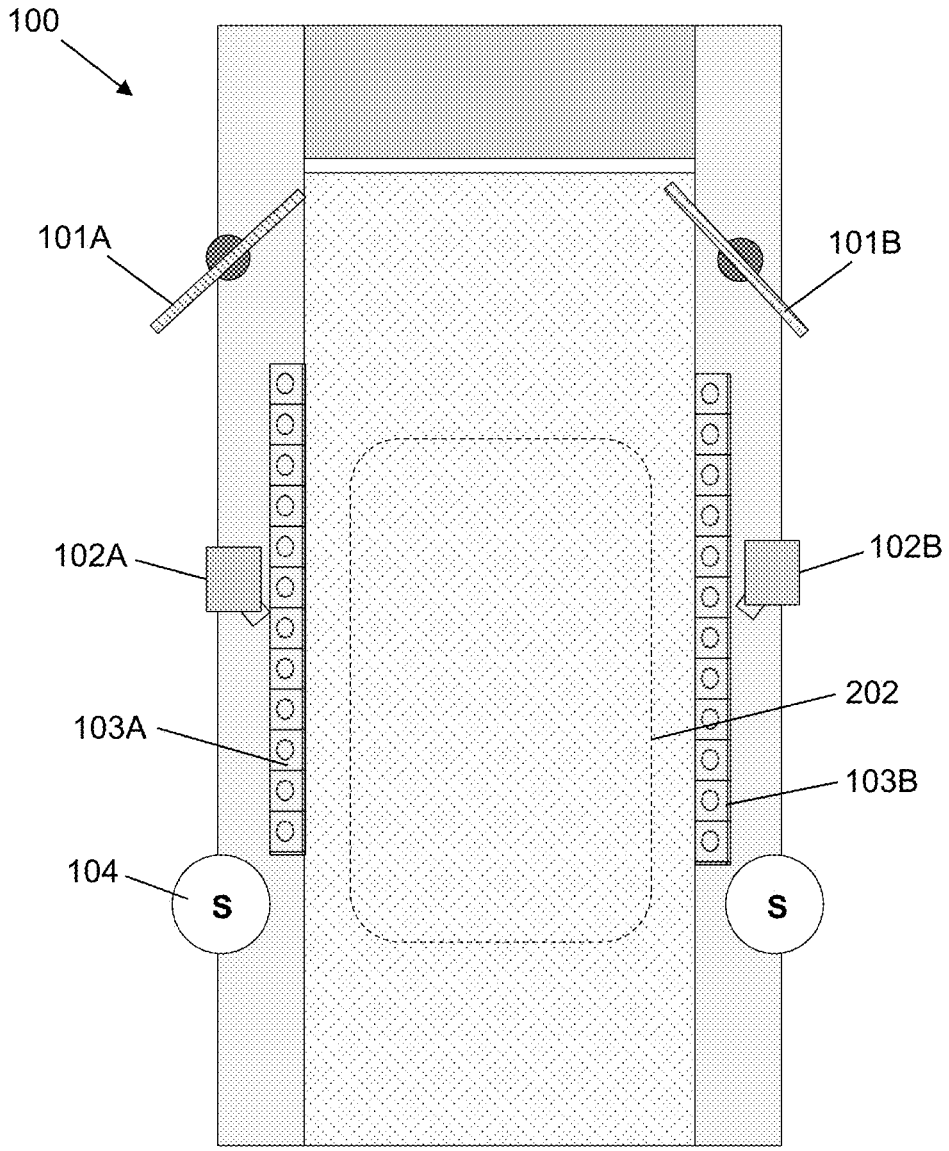
FIG. 2 shows a top view of an illustrative embodiment of a treadmill.

FIG. 2 shows a top view of a treadmill 100 where both rails can have the monitors 101A and 101B positioned such that the user, preferably located in the region 202, can easily observe the monitors 101A and 101B while running. It is understood that the treadmill 100 can be further supplemented by a monitor placed far in front of the user such that it does not constrain the user's motions regardless of where the user is positioned or how far the user leans forward or strides forward. The S buttons 104 can be used to stop the treadmill 100, and the monitors 101A and 101B can show different information for the user. For example, monitor 101A can show the running status of the user, while the monitor 101B can show a movie, a virtual path, or other user desired information. The running status information can include physiological information, information on the distance, speed, incline, time, and/or the like, as well as warning information in the event the user is located too far forward or backward from the region 202. The levers 102A and 102B are shown as discussed, and the multitude of controls over rails is schematically illustrated by control units 103A and 103B.

Figure 3A:
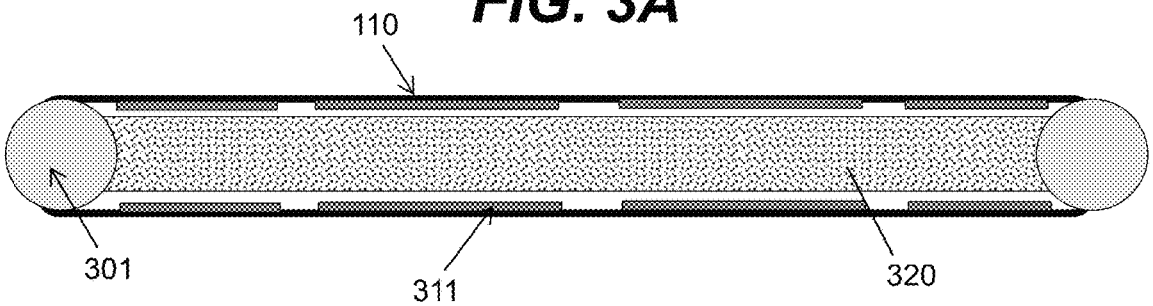
FIGS. 3A-3C show possible sensors positioned underneath a treadmill belt according to embodiments.
Figure 3B:
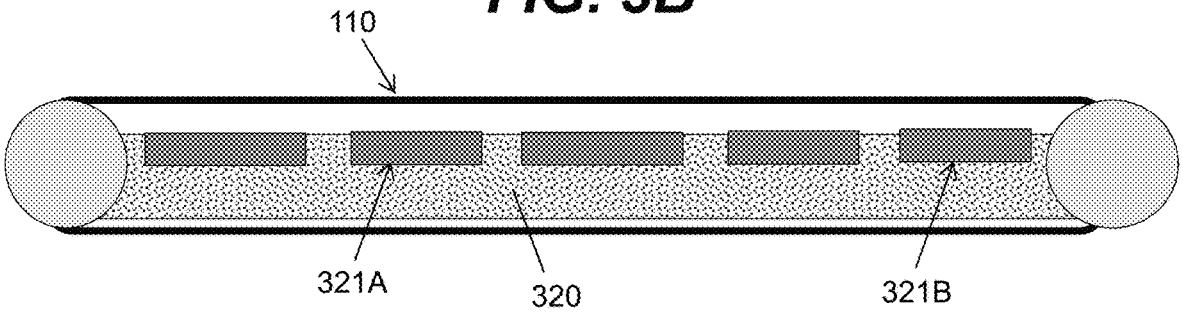
Figure 3C:
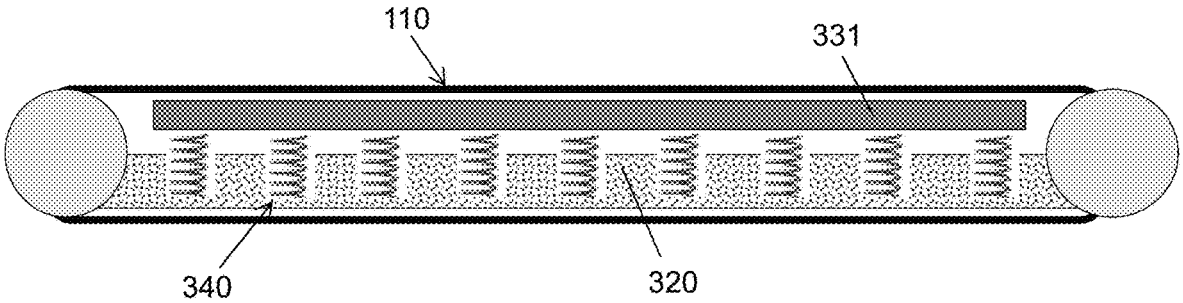

FIGS. 3A-3C show possible sensors 311, 321, 331 built into the treadmill belt 110 and/or into the deck 320 of treadmill 100 (see, FIG. 1) according to embodiments. The sensors can be used to acquire data, which can be processed to determine various information regarding the user, such as the lengthwise and/or lateral position of the user, the impact of the user on the treadmill belt 110, the duration of the time the user foot is in contact with the treadmill belt 110, and/or the like. Such information can be used to provide feedback to the user, such as a calculation of the calories burned by the user, a running form of the user, the number of strides per minute that the user is making, as well as the area of contact of the user foot with the treadmill 100. Any combination of various types of sensors can be used. For example, the sensors can comprise piezoelectric actuators that respond to a pressure by generating electrical voltage. Furthermore, the sensors can include accelerometers that indicate how much force is exerted on a sensor patch by the user's foot.

In one embodiment, the sensor pad comprises a removable unit capable of sliding underneath the treadmill belt 110 over a treadmill deck 320 (upon which the belt is moving) to provide a sensing unit capable of being replaced. Alternatively, the unit can be embedded into the deck 320 of the treadmill 100. In yet another embodiment, the treadmill bed can contain one or more sections, wherein the sensor(s) are inserted. A sensor can be, for example, attached to the deck 320 in a matter to provide a smooth interface over the deck 320. In such a configuration, the sensor can be placed in a cavity within the deck 320 designed to incorporate the sensor without the sensor protruding from the deck 320. Regardless, the sensors can be electrically connected to a controlling, analyzing, and/or power component within the treadmill 100. Furthermore, the sensors may communicate with the controlling, analyzing and power component using a wired or wireless communications solution.

The analyzing component (e.g., a computer system described herein) obtains the data from the sensors, calculates appropriate information for the user (such as calorie count, the impact force, the number of strides per minute, etc) and can display the information on a monitor. The controlling component can be used to adjust the sensitivity of a sensor component, or to adjust the sensor based on a user having a particular weight or other characteristics (foot size, for example). The sensing component can further analyze stride rate and stride distance for each leg.

The stride sensing can be combined with other biological/physiological information monitored while the user is using the treadmill 100, e.g., running, jogging or walking. For example, characteristics of the user stride can be correlated with the user's heart rate, or the user's breath rate or breath depth. The heart and the breath rate can be measured by, for example, sensors located over the user's chest. Alternatively, the stride sensors can be combined with other sensors located at other parts of the treadmill. For example, the treadmill can incorporate optical sensors detecting the position and the location of different parts of the user's body. For instance, the optical sensors can keep track of the position of the user's trunk (inclination as a function of time) as well as position of the user's hands. All this information can be correlated with heart rate and breath rate sensors and recorded into computer memory for further analysis.

The sensors can be combined with a control system (e.g., a computer system described herein), which can generate an alarm for presentation to the user. For example, such an alarm can be generated if the heart rate is above a target heart rate, or if the user has a non-uniform (un-even) stride pattern or stride rate. Additionally, the alarm system can be combined if the user is located outside the safe area on the treadmill (e.g., too far to one side or too close to either end of the treadmill). Furthermore, the sensor system can detect a stress on the user's knee, e.g., by measuring the stride impact on the treadmill belt 110, and evolution of the impact force (as well as the duration of impact) as a function of time through an exercise routine.

FIG. 3A shows a configuration where a sensor pad 311 is located within the structure of the belt 110 and moves with the belt 110. Such sensors 311 can be sufficiently small and durable to go around the rollers 301 of the treadmill 100. Communications with such sensors can utilize a wireless communications solution. For example, such sensors can generate a short wireless communication (e.g., a radio frequency signal) in response to being compressed by a stride of the user. FIG. 3B shows another embodiment, where sensor pads 321A, 321B are placed within the deck 320 surface. In such an embodiment, the sensors 321A, 321B can be electrically connected to the deck system, are motionless, and may provide a longer operating lifetime. It is clear that there can be a number of sensors 321A, 321B, with each sensor 321A, 321B having a similar or different configuration, and a similar or different operational principle. For example, some sensors can rely on piezoelectric effects, while other sensors can utilize mechanical units (such as spring, or gas based sensors) to detect the impact of a user's foot. Furthermore, the sensors 321A, 321B can duplicate each other, and produce an alarm when one of the sensors fails to read the user's impact characteristics. The sensors can be configured to be easily replaceable when damaged. FIG. 3C shows an example of a sensor 331 that utilizes a mechanical spring system 340 to measure the impact of the user's feet.

Figure 4A:
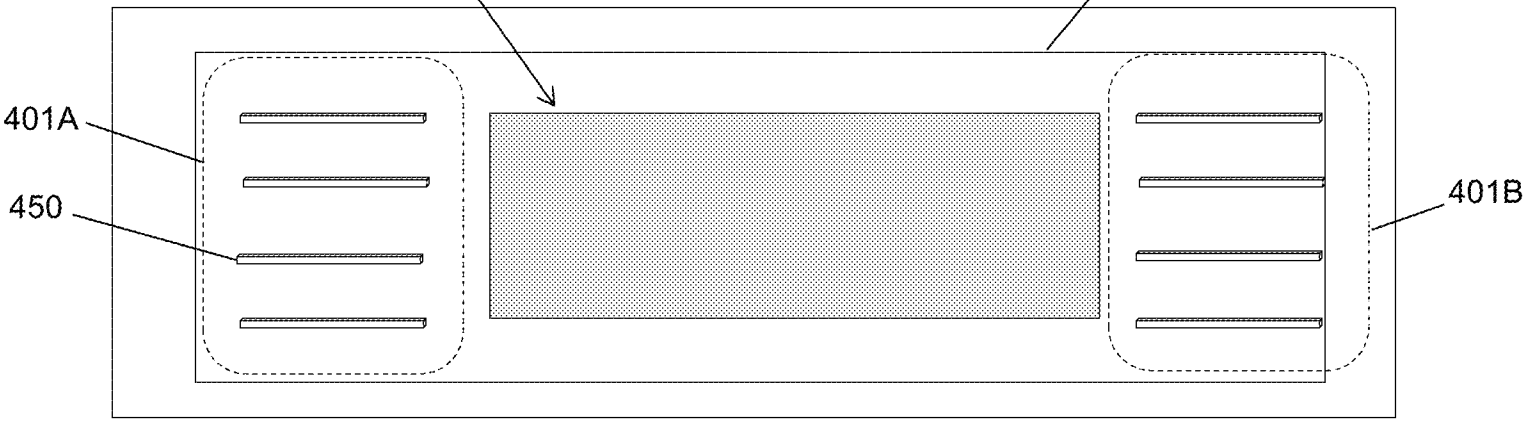
FIGS. 4A-4B show possible texture distributions located underneath a treadmill belt and/or within a treadmill belt according to embodiments.
Figure 4B:
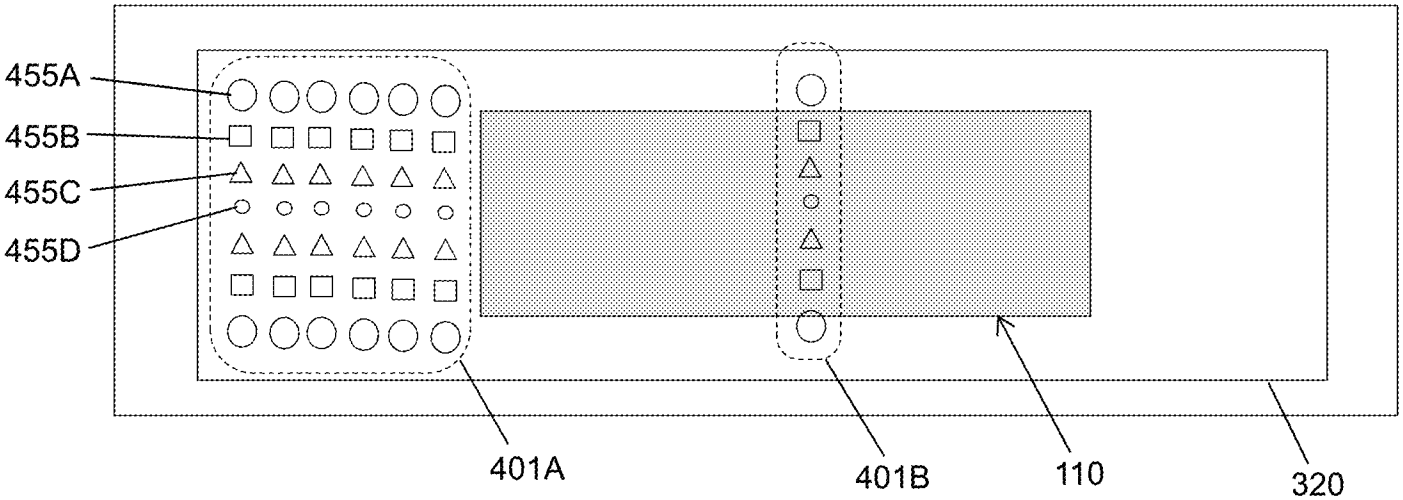

In an embodiment, a treadmill described herein is configured to provide tactile feedback to a user regarding his/her position on the platform. For example, FIGS. 4A and 4B show embodiments where surface variation, such as texture, can be used to give a user an idea of where he/she is located on the platform without an additional need for the user to look down towards his/her feet. For instance, FIG. 4A shows textured portions 401A, 401B that indicate to the user that he/she is near the front or the rear area of the platform. The texture portions 401 can comprise, for example, rubbery indentations 450 which are inlaid upon the deck 320, positioned in line with the deck surface 320. Similar to rumble strips on the shoulder of a highway, at the forward and rear ends of the deck 320, the texture portions 401 can provide tactile feedback to prompt the user that he/she is located too far toward the front or back of the platform.

FIG. 4B shows an additional embodiment where the texture portions 401A, 401B can include textured patterns 455 that may further be differentiated in the belt transverse direction (from left rail of treadmill 100 towards the right rail of a treadmill 100) to provide tactile feedback to the user regarding where he/she is with respect to the lateral position on platform. In such a configuration, different texture patterns 455A, 455B, 455C, 455D may be used as shown by different domains or shape (circles, squares, triangles and so on). As indicated, the texture pattern 455 can be overlaid over the deck 320. In an embodiment, the texture pattern 455 can comprise a rubber textured unit attached to the deck 320. In yet another embodiment, the textured pattern 455 can be overlaid on a sensor unit described herein. The user can both feel the textures with his/her feet as well as obtain a sensor reading about the user's strides. In addition, the monitor system described herein can further inform the user about his/her location on the belt. As seen from FIG. 4B the texture portions 401A, 401B can be located not only in the front and/or the rear of the treadmill 100 but also in the middle of the treadmill belt 110, and in general, at any appropriate place in a treadmill 100.

In an embodiment, only the outer lateral and lengthwise regions of the platform include surface variation, such as textured surfaces, while the target region within which the user is intended to be located can include no texturing. It is understood that while textured surfaces are shown as providing the tactile feedback, embodiments can utilize alternative approaches for providing tactile feedback to the user. For example, an embodiment of the surface variation can include varying a hardness of the surface to provide feedback to the user when his/her foot impacts the surface.

Furthermore, surface variation sufficient to provide tactile feedback to the user, such as texturing, differing hardness/softness, differing traction, and/or the like, can be incorporated into the belt member in an embodiment. Such surface variation can be used to provide the user with feedback regarding a lateral location of the user on the belt. In this case, the surface variation can differ depending on the lateral location of the belt. For example, the outer lateral regions of the belt can include varying texture detectable when impacted by the user's foot, while the laterally central region of the belt can be smooth or include minimal surface variation not detectable by a typical user wearing footwear. Additionally, such surface variation can be configured to provide a simulated outdoor running environment. Regardless, an embodiment of the belt can include large scale regions of thicker belt material, and/or an alternative material embedded in the belt material, which can provide tactile feedback to the user when his/her foot impacts such regions.

Figure 5A:
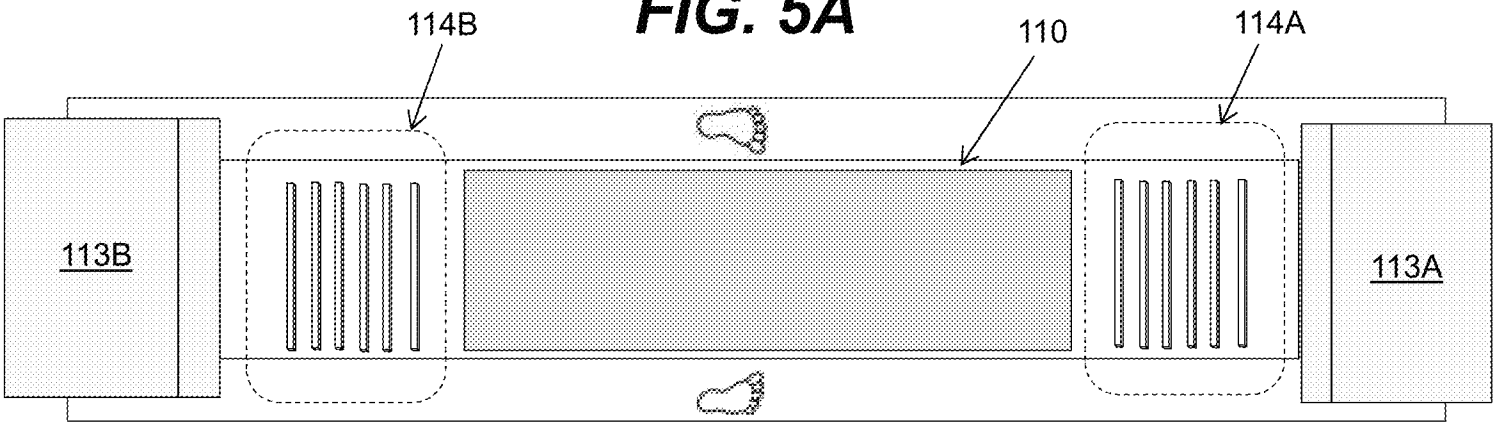
FIGS. 5A and 5B show an illustrative embodiment of a treadmill with sufficient width between the belt and side of the treadmill to step off, a sensor pad built into the deck, further texture distributions positioned laterally at the front and back areas of the deck and a ramp or flat front and back surface.
Figure 5B:
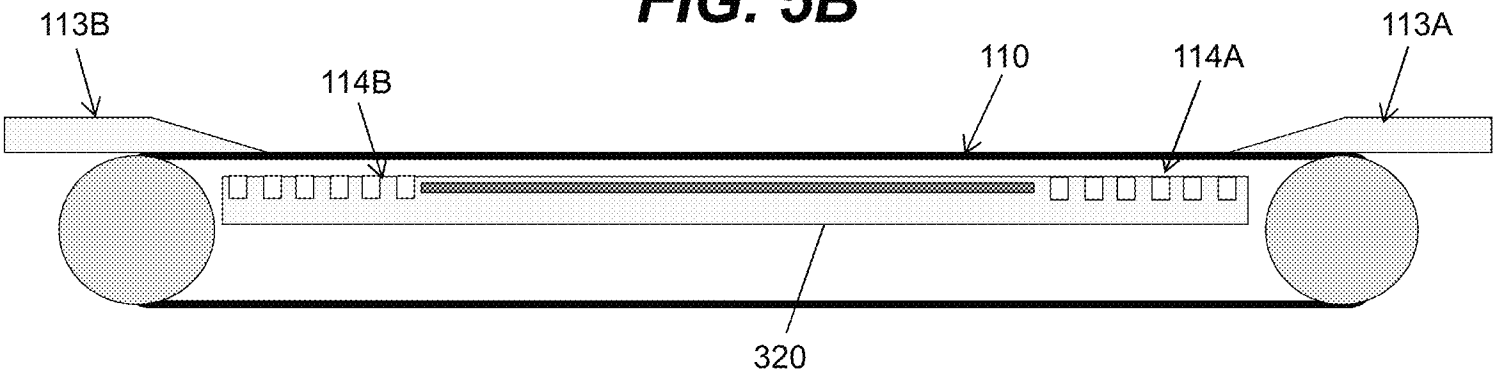

FIG. 5A shows an embodiment where the treadmill 100 is further equipped with adequate width between the belt 110 and the side edge to allow the user to step-off the moving belt 110 without stopping the treadmill 100. The user can achieve this by holding rails, supporting the weight of user body by user's arms, lifting the feet and placing them on stationary step-off platforms for resting while running or walking on a treadmill 100. As shown, the embodiment accommodates a user having his/her feet positioned far apart at the location in proximity of pads. FIGS. 5A and 5B show lateral indentations 114A and 114B under the front and rear sections of the deck 320 which are intended to act as rumble strips to warn the user when the user travels to far forward or backward.

FIGS. 5A and 5B also show front and rear structures 113A and 113B including ramped surfaces located at a front and rear areas, where the structures can cover the respective front and rear non-usable areas of the surface of the platform (e.g., above the rollers) in order to provide tactile feedback and safety for the user. An embodiment of the rear structure 113B can be configured in a same manner as described herein in conjunction with the front structure.

Figure 6A:
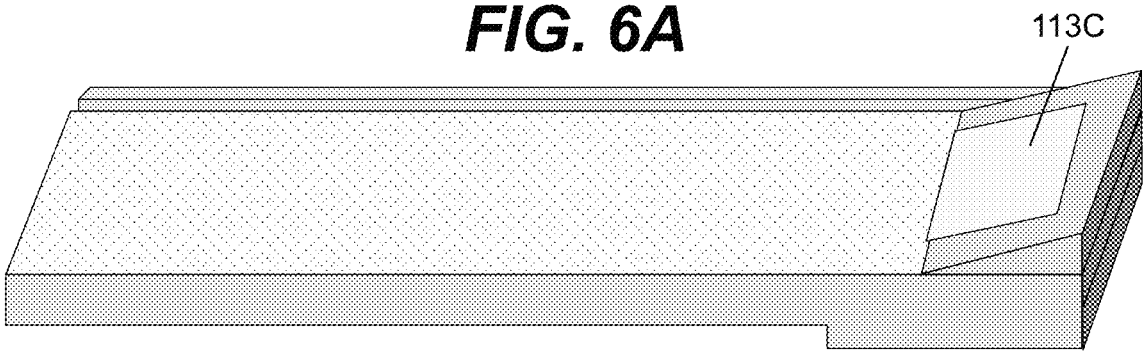
FIGS. 6A-6C show possible surface configurations of a ramp configured to allow the foot to slide safely and effectively off the front ramp and back to the belt according to embodiments.
Figure 6B:
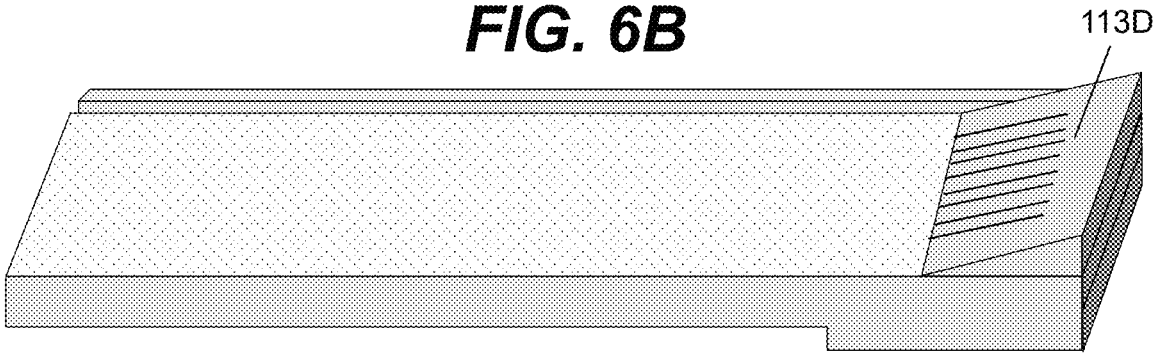
Figure 6C:
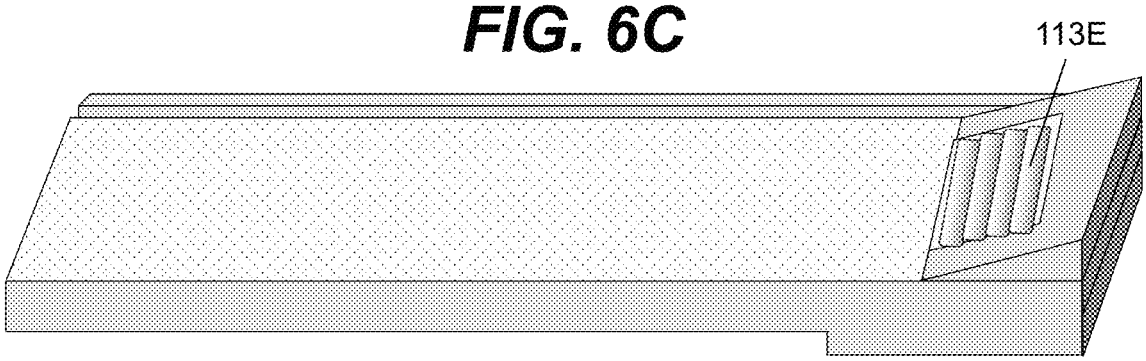

FIGS. 6A-6C show possible ramped surfaces which will allow the foot to slide safely and effectively off the ramp 113 and back to the belt 110. In a non-limiting example, FIG. 6A shows a ramp 113C including a substantially smooth surface with a low friction material that may allow the shoe of a user of the treadmill 100 to slide off of the ramp 113C and back onto the belt 110. The smooth surface of ramp 113C shown in FIG. 6A may be formed integrally with ramp 113C or may be a separate component coupled to ramp 113C, or may be a coating formed on a portion of ramp 113C. The smooth surface can be positioned in line with belt 110 and/or the running path of a user of treadmill 100. In non-limiting examples, the smooth surface may be formed from a separate material or coating, such as Teflon, anodized aluminum, ceramics, silicone and other "non-stick" materials or coatings.

In another non-limiting example shown in FIG. 6B, the ramp 113D may include longitudinal ridges. The longitudinal ridges formed on ramp 113D may lower the friction of a contact surface of ramp 113D and may allow a user's foot to more easily slide off of the ramp 113D when contact occurs. The longitudinal ridges may be substantially curved or rounded in shape to decrease potential friction between ramp 113D and a user's foot. The longitudinal ridge of ramp 113D may protrude from ramp 113D and may be formed from a hard plastic or metal to also aid in the reduction of friction for ramp 113D.

In a further non-limiting example, a ramp 113E may include at least one roller. Specifically, and as shown in FIG. 6C, ramp 113E may include a plurality of rollers mounted laterally into the ramp 113E. The plurality of rollers of ramp 113E may be free to move and/or rotate independent of one another. The rollers of ramp 113E may guide a user's foot back to belt 110 when the foot contacts the rollers by rotating toward belt 110 and moving the user back toward belt 110. The ramp 113E including the rollers may also prevent the user from moving forward when stepping on ramp 113E by not having a fixed or static surface and/or by directing the users foot back toward the belt with each rotating roller. It is understood that other embodiments are possible. For example, the ramp can include a field of ball bearings, which will allow the user's foot to return to the belt when impacted by a running stride.

Figure 7:
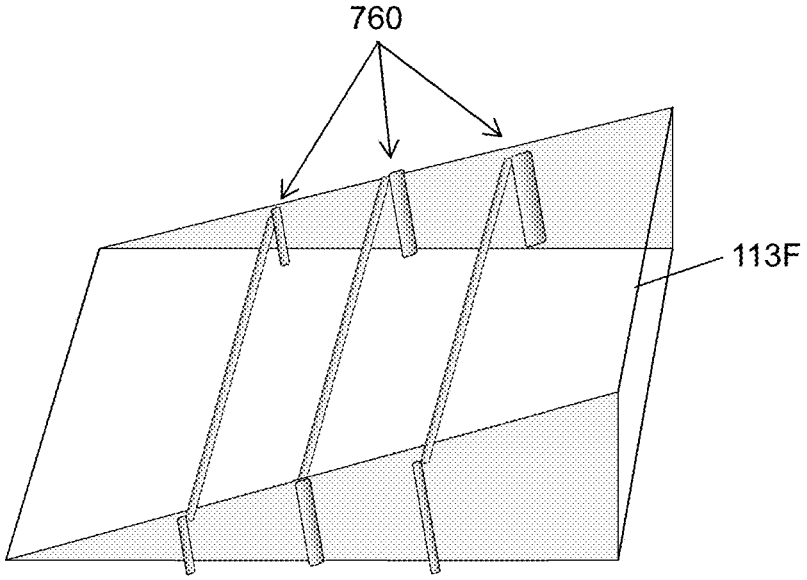
FIG. 7 shows a front ramp with lattice built in to provide structural support required to prevent the ramped surface from bending when struck by a user's foot according to an embodiment.

FIG. 7 shows a front ramp 113F with lattices 760 built in to provide structural support required to prevent the ramp 113F from bending or otherwise being damaged when struck by a user's foot. Specifically, the lattices 760 of ramp 113F may provide additional strength and/or structure support in an area most commonly contacted by a user of treadmill 100 to prevent the ramp 113F from becoming damaged and/or broken and ultimately preventing the ramp 113F from providing the safety discussed herein. A single piece of material forming the ramp 113F with adequate structure built in may also be adequate to prevent the surface from bending into the motor compartment or simply cracking under pressure of a user of treadmill 100. In an embodiment, the ramp 113F is configured to withstand a foot strike from a running user weighing at least 230 pounds without damage to the ramp 113F or any other structure including the ramp 113F.

Although shown and discussed herein as having an inclined surface, it is understood that the ramp 113 of treadmill 100 may be replaced by a component that is substantially flat. Specifically, a flat surface or component may replace ramp 113 and provide similar safety and warning benefits as the ramp 113. For example, and as discussed herein, a flat surface or component positioned in a similar area and/or replacing ramp 113 on the treadmill 100 may provide safety measures and tactile feedback to a user of treadmill 100. For example, a flat component positioned on a front of treadmill 100 and covering a front portion of treadmill belt 110 may prevent a user from running off the front of treadmill 100 by providing a distinct surface having distinct properties, structures and attributes as the treadmill belt 110. These distinct properties, structures and attributes may provide a tactile indicator to the user of the treadmill 100 that he/she has stepped on the flat component and not the moving treadmill belt 110.

As discussed herein, embodiments can dynamically adjust one or more aspects of the rotation of the belt based on a position of the user on the platform and/or one or more targets for the user. To this extent, FIGS. 8A (front sensors) and 8B (rear sensors) show basic programming logic for translating sensor feedback to dynamically increase or decrease belt speed according to an embodiment, while FIGS. 8C (front sensors) and 8D (rear sensors) show basic programming logic for translating sensor feedback to alter the resistance according to an embodiment. For example, in each case, a momentary interruption (e.g., less than a target number of milliseconds) of the sensor beam may be ignored. The duration of the time value can be altered in the program and can be learned and adjusted over a number of uses. For example, the duration can be varied based on a speed of the belt, with longer interruptions ignored when the belt is moving slower. In either case, a short duration interruption above the minimum threshold but below a maximum threshold can result in a small change, such as 0.1 mph, in speed or a small change in Watts for resistance. As illustrated, the speed is increased in response to the front sensors detecting such a blockage and decreased in response to the rear sensors detecting such a blockage. As also illustrated, the resistance is decreased in response to the front sensors detecting such a blockage and increased in response to the rear sensors detecting such a blockage.

A longer duration (e.g., above the maximum threshold) or continuous obstruction may cause a continuous change in speed or resistance (increase or decrease depending on the front or rear blockage and change in speed or resistance) until the obstruction is removed. In the case of a longer duration or continuous obstruction, the rate of speed or resistance change in response may change increasingly rapidly in correlation with the duration of the obstruction. In the case of an ultimate sensor or set of sensors in the rear is blocked, the belt speed may be reduced rapidly to a safe stop.

While the adjustments are shown and described in conjunction with the duration of obstructions, it is understood that adjustments can be made using alternative sensor data. For example, when multiple sensors are located lengthwise along the treadmill, a location of the sensors reporting blockages can be used to determine the corresponding adjustment. In this case, blockages of sensors too far forward or rear, but more centrally located can result in small adjustments, while blockages of sensors located even further forward or rear can result in larger adjustments. Similarly, sensors located in the treadmill platform also can be utilized to determine whether the user is located too far forward or rear and result in a corresponding adjustment.

Figure 8A:
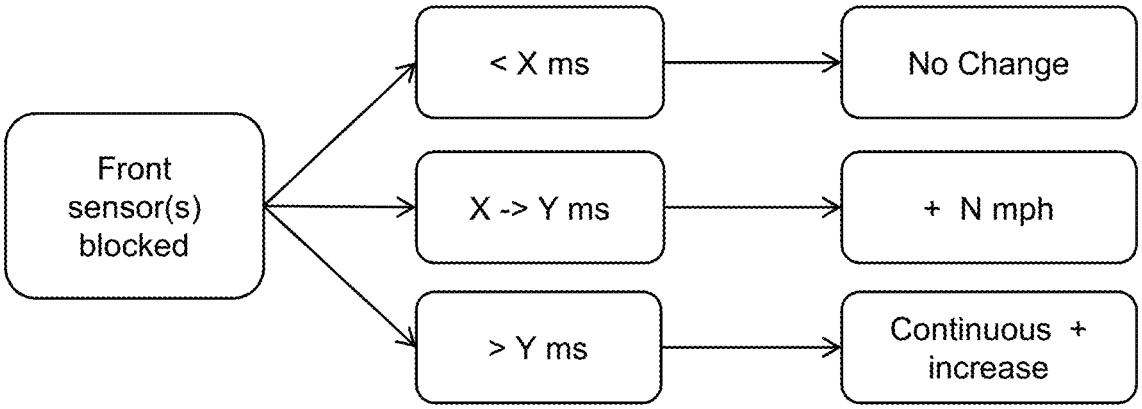
Figure 8B:
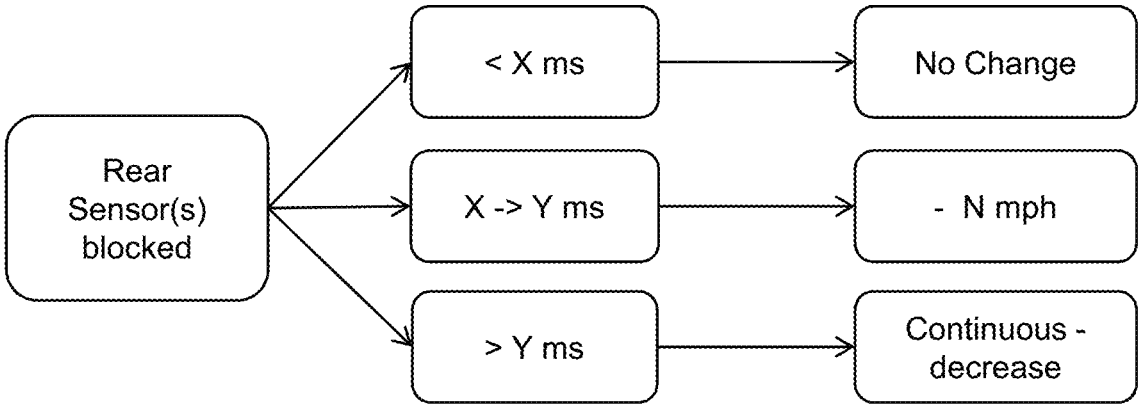
Figure 8C:
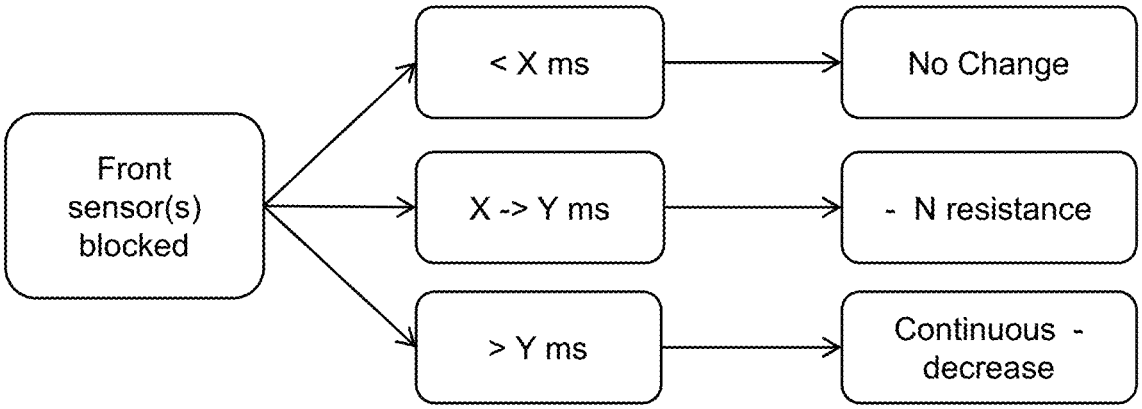
FIGS. 8C and 8D show basic programming logic for translating sensor feedback to decrease belt speed or alter the resistance according to an embodiment.
Figure 9A:
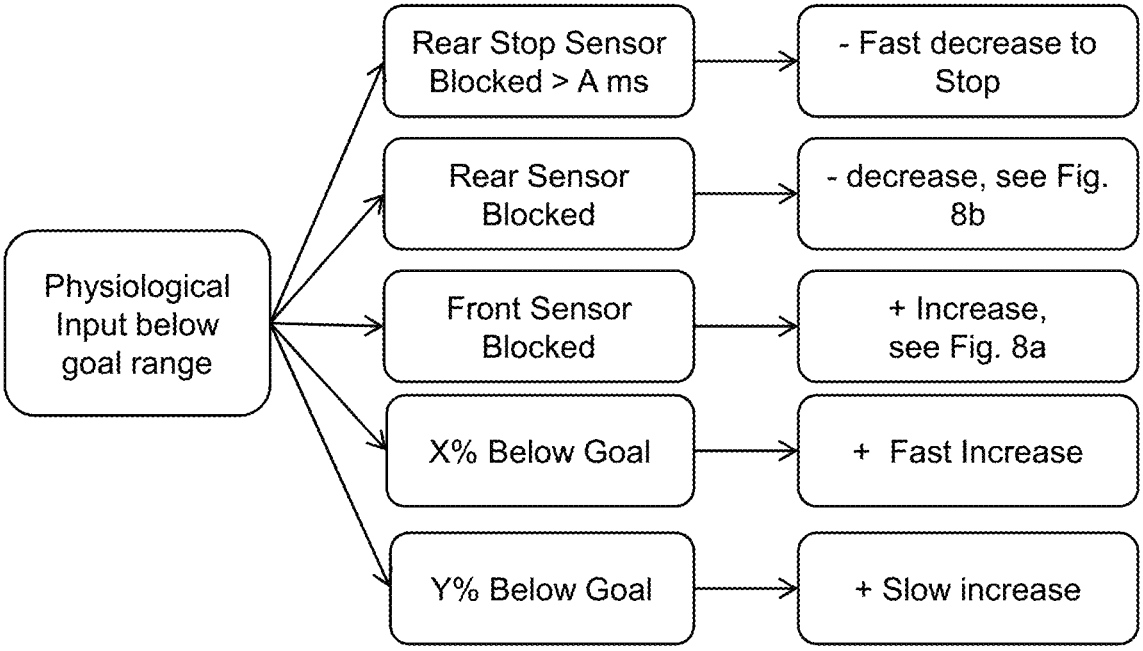
FIGS. 9A and 9B show basic programming logic for translating physiological goals to increase or decrease belt speed, dependent upon location sensor feedback which may over-ride physiological goals, according to an embodiment.
Figure 9B:
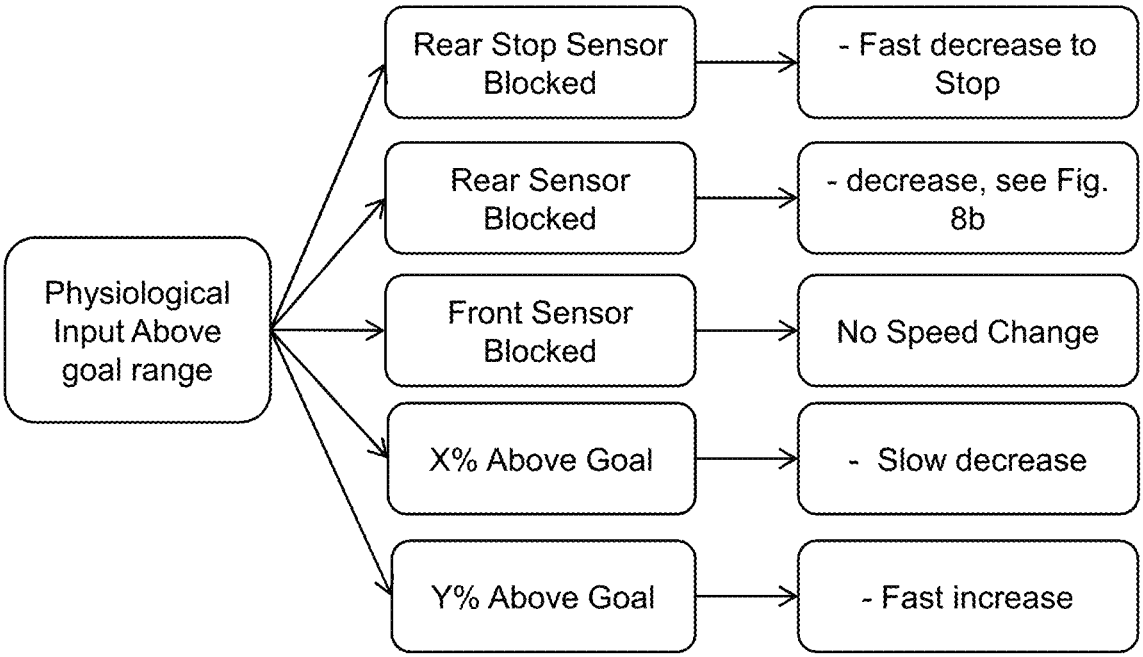

FIGS. 9A and 9B add a physiological target (e.g., heart rate, body temperature, blood oxygen levels, and/or the like) for adjusting rotation (e.g., speed or resistance) of the belt. For example, a physiological input can have an associated target range of the physiological input to achieve and maintain. While the sensor trap of FIGS. 8A-8B is intended to keep the user in a physical longitudinal section of the treadmill, the physiological approach in FIGS. 9A and 9B aims to keep the user in a specified effort level range, subject to remaining safely within the sensor trap in FIGS. 8A-8B, and safe from being carried off the back of the treadmill in the case the physiological range is not achievable due to, for example, fatigue.

Figure 10A:
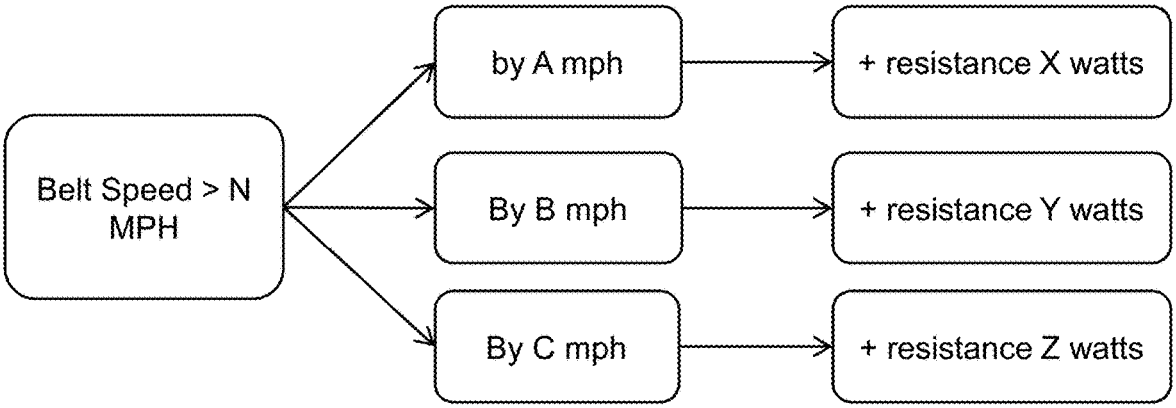
FIGS. 10A and 10B show basic programming logic for, in a non-motorized user driven model, altering the resistance to assist the user in achieving a target running speed according to an embodiment.
Figure 10B:
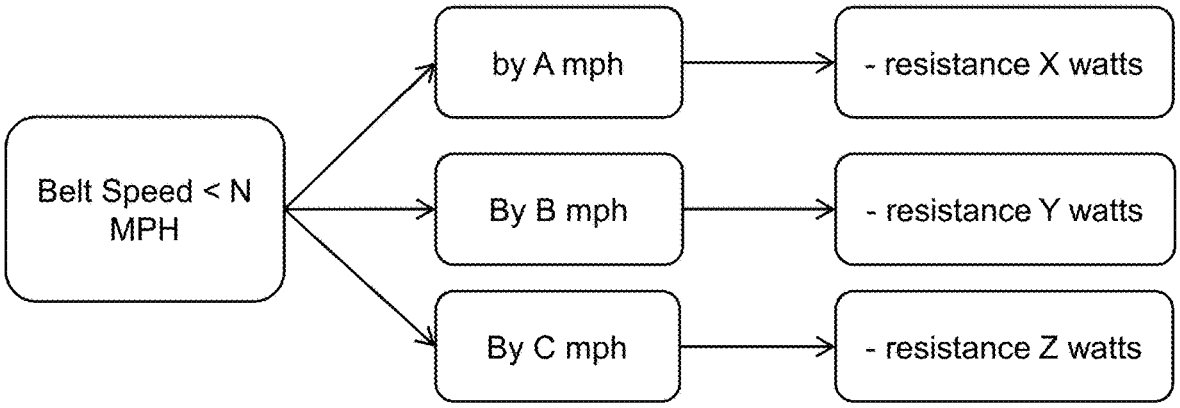

FIGS. 10A and 10B show basic programming logic for, in a non-motorized user driven model, altering the resistance to gradually help the user achieve a target running speed according to an embodiment. Depending on the variance from the target speed (A, B or C mph), a varying amount of resistance change may occur (X, Y or Z watts) to help return the user gradually to the target speed. In more advanced cases, the speed and wattage response ranges could be more numerous, and the treadmill may also respond by altering the incline to help the user adjust his/her speed.

Figure 8D:
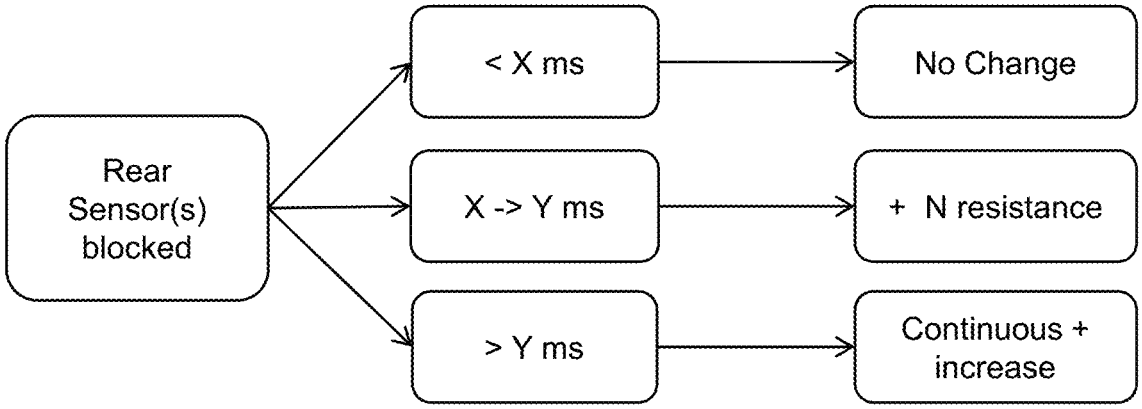
Figure 11A:
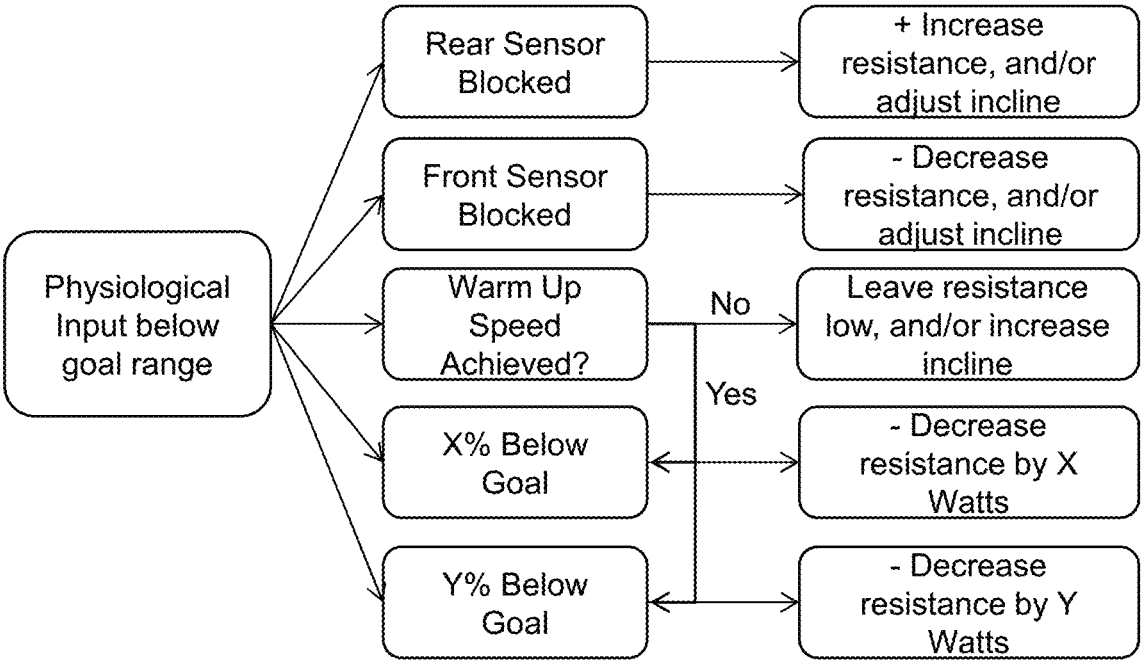
FIGS. 11A and 11B show basic programming logic for translating physiological goals to increase or decrease resistance, dependent upon location sensor feedback which may over-ride physiological goals, according to an embodiment.
Figure 11B:
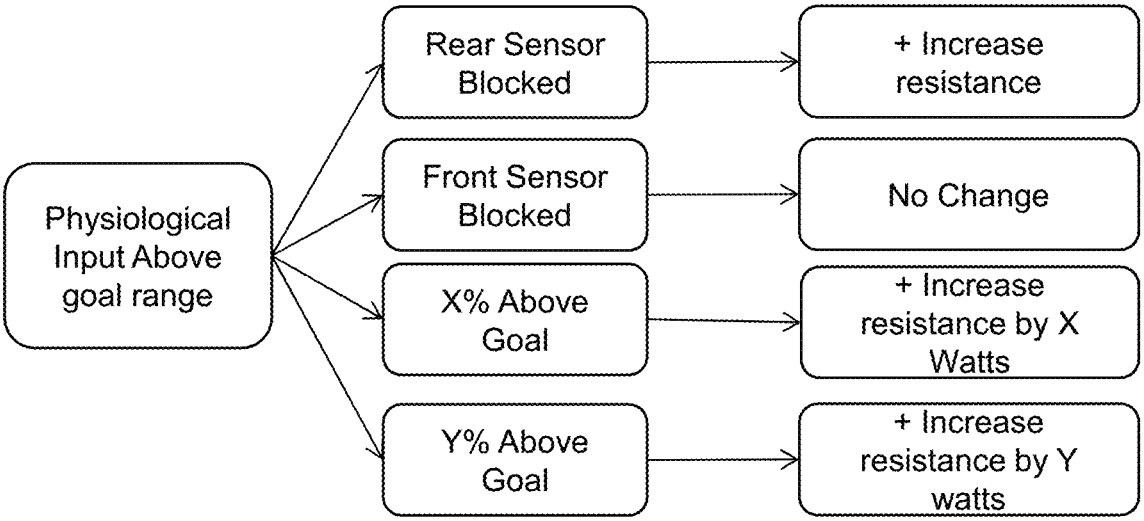

FIGS. 11A and 11B show basic programming logic for translating physiological goals to increase or decrease resistance utilizing a non-motorized, user driven approach, dependent upon location sensor feedback which may override physiological goals, according to an embodiment. In this case, sufficiently low resistance and/or sufficiently high inclination can be provided to achieve a minimum belt speed. The belt speed and inclination can be used to drive the user to a certain physiological performance range, and keep the user in that range, except when the user strays too far toward the back or front of the treadmill as detected by the sensor trap, such as that described in conjunction with FIGS. 8C and 8D.

Figure 12:
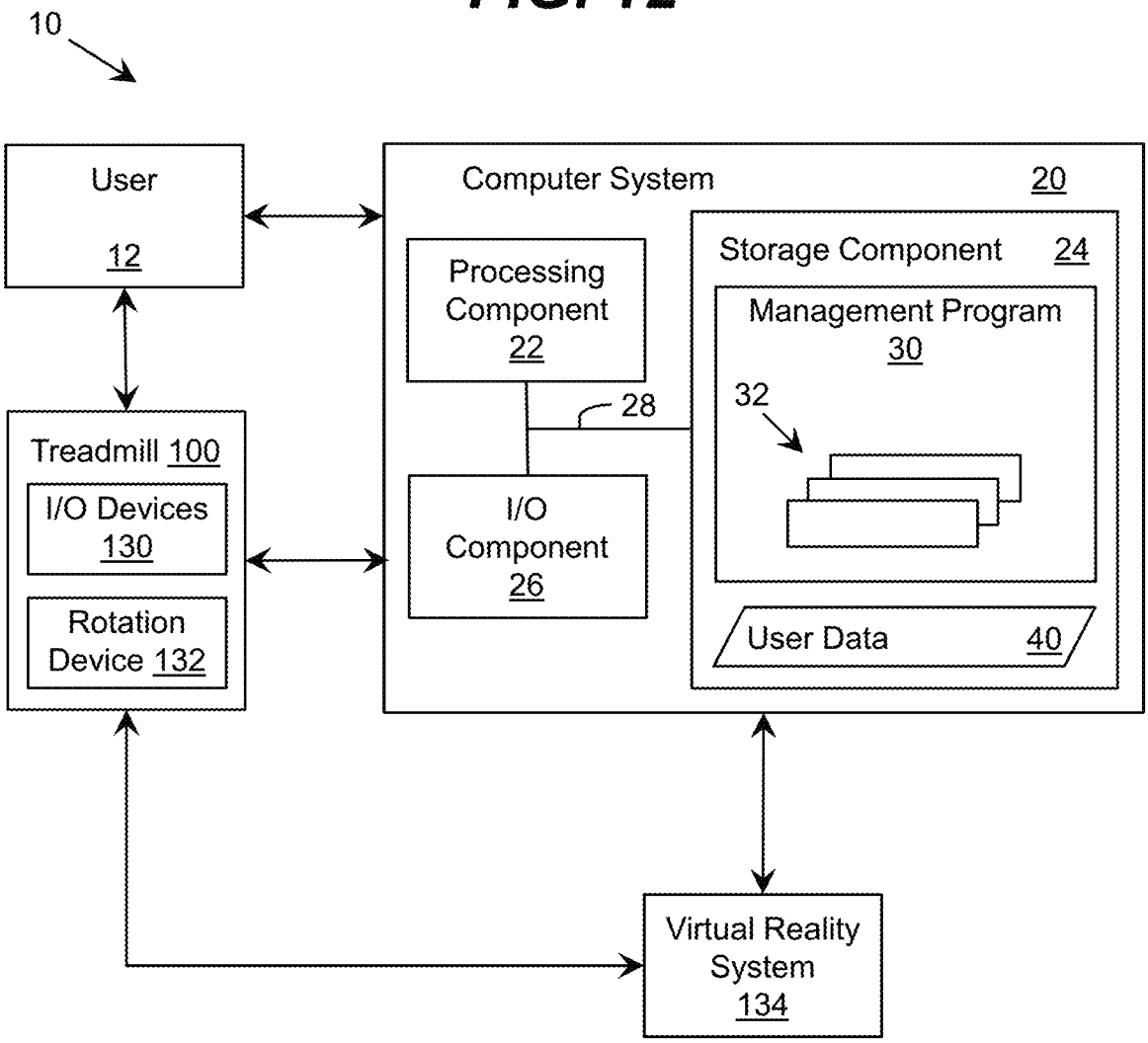
FIG. 12 shows an illustrative environment for managing treadmill operation using a process described herein according to an embodiment.

The programming logic shown in FIGS. 8A-11B can be executed on a computer system, which can receive data from sensors on the treadmill, process the data, and adjust operation of one or more components of the treadmill in response. To this extent, FIG. 12 shows an illustrative environment 10 for managing treadmill 100 operation using a process described herein, according to an embodiment. In this case, the environment 10 includes a computer system 20 that can perform a process described herein in order to, for example, detect the position of the user 12 on treadmill belt 110 of treadmill 100 and/or initiate one or more responses to the position of the user 12 as described herein. In particular, the computer system 20 is shown including a management program 30, which makes the computer system 20 operable to detect the position of the user 12 on treadmill 100 and, if necessary, initiate one or more responses to the position of the user 12 by performing a process described herein.

The computer system 20 is shown including a processing component 22 (e.g., one or more processors), a storage component 24 (e.g., a storage hierarchy), an input/output (I/O) component 26 (e.g., one or more I/O interfaces and/or devices), and a communications pathway 28. In general, the processing component 22 executes program code, such as the management program 30, which is at least partially fixed in storage component 24. While executing program code, the processing component 22 can process data, which can result in reading and/or writing transformed data from/to the storage component 24 and/or the I/O component 26 for further processing. The pathway 28 provides a communications link between each of the components in the computer system 20. The I/O component 26 can comprise one or more human I/O devices, which enable a human user 12 to interact with the computer system 20 and/or one or more communications devices to enable a system user to communicate with the computer system 20 using any type of communications link. To this extent, the management program 30 can manage a set of interfaces (e.g., graphical user interface(s), application program interface, and/or the like) that enable human and/or system users 12 to interact with the management program 30. Furthermore, the management program 30 can manage (e.g., store, retrieve, create, manipulate, organize, present, etc.) the data, such as user data 40, using any solution.

In any event, the computer system 20 can comprise one or more general purpose computing articles of manufacture (e.g., computing devices) capable of executing program code, such as the management program 30, installed thereon. As used herein, it is understood that "program code" means any collection of instructions, in any language, code or notation, that cause a computing device having an information processing capability to perform a particular action either directly or after any combination of the following: (a) conversion to another language, code or notation; (b) reproduction in a different material form; and/or (c) decompression. To this extent, the management program 30 can be embodied as any combination of system software and/or application software.

Furthermore, the management program 30 can be implemented using a set of modules 32. In this case, a module 32 can enable the computer system 20 to perform a set of tasks used by the management program 30, and can be separately developed and/or implemented apart from other portions of the management program 30. As used herein, the term "component" means any configuration of hardware, with or without software, which implements the functionality described in conjunction therewith using any solution, while the term "module" means program code that enables a computer system 20 to implement the actions described in conjunction therewith using any solution. When fixed in a storage component 24 of a computer system 20 that includes a processing component 22, a module is a substantial portion of a component that implements the actions. Regardless, it is understood that two or more components, modules, and/or systems may share some/all of their respective hardware and/or software. Furthermore, it is understood that some of the functionality discussed herein may not be implemented or additional functionality may be included as part of the computer system 20.

When the computer system 20 comprises multiple computing devices, each computing device can have only a portion of the management program 30 fixed thereon (e.g., one or more modules 32). However, it is understood that the computer system 20 and the management program 30 are only representative of various possible equivalent computer systems that may perform a process described herein. To this extent, in other embodiments, the functionality provided by the computer system 20 and the management program 30 can be at least partially implemented by one or more computing devices that include any combination of general and/or specific purpose hardware with or without program code. In each embodiment, the hardware and program code, if included, can be created using standard engineering and programming techniques, respectively.

Regardless, when the computer system 20 includes multiple computing devices, the computing devices can communicate over any type of communications link. Furthermore, while performing a process described herein, the computer system 20 can communicate with one or more other computer systems using any type of communications link. In either case, the communications link can comprise any combination of various types of optical fiber, wired, and/or wireless links; comprise any combination of one or more types of networks; and/or utilize any combination of various types of transmission techniques and protocols.

In any event, the computer system 20 can obtain the user data 40 using any solution. For example, the computer system 20 can obtain data regarding the user 12 and/or provide data for presentation to the user 12 by operating a set of I/O devices 130 located on the treadmill 100 and/or the user 12. The set of I/O devices 130 can include any combination of the various sensors, emitters, input devices, output devices, and/or the like, as described herein. The user data 40 can include data regarding a position of the user 12, physiological data of the user 12, a target setting (e.g., speed, heart rate, etc.) of the user 12, an exercise routine, a setting adjustment, and/or the like. The computer system 20 can process data acquired using the set of I/O devices 130 to generate user data 40. Alternatively, the computer system 20 can obtain user data 40 directly from one or more sensors 103 associated with the treadmill 100. Regardless, the computer system 20 can utilize the user data 40 to adjust operation of one or more of the set of I/O devices 130 and/or a rotation device 132 (e.g., an electric motor, a variable resistance device, and/or the like) as described herein.

In addition to identifying the position of the user 12 on the treadmill, it is understood that the computer system 20 can perform one or more additional actions described herein, such as: adjust one or more attributes of the operation of the treadmill 100 (e.g., speed or resistance of the belt, inclination of the platform); generate data for presentation on a monitor associated with the treadmill; operate one or more warning devices in response to data acquired using the set of I/O devices 130; adjust one or more aspects of the treadmill 100 in response to input from the user 12; and/or the like.

As further discussed herein, the treadmill 100 can be used in conjunction with a virtual reality system 134 to provide the user 12 with a simulated exercise environment. In this case, the virtual reality system 134 can include components for acquiring data regarding the position of the user 12 on the treadmill 100 (e.g., from one or more I/O devices 130 located on the treadmill 100) and process the data to generate the simulated, immersive exercise environment. For example, the virtual reality system 134 can include one or more user wearable components, such as a headset, which include a computer system and corresponding output devices for generating and presenting the simulated environment. It is understood that the virtual reality system 134 can include a computer system 20 configured as described herein in conjunction with the computer system 20. Furthermore, it is understood that the virtual reality system 134 can share one or more components with the computer system 20 and/or the treadmill 100.

While primarily shown and described in conjunction with a single treadmill 100 and user 12, it is understood that embodiments can include multiple treadmills 100 and/or users 12. For example, an embodiment can include multiple treadmills 100 implementing an identical routine, such as a workout routine, a simulated race over a course, and/or the like. In this case, the treadmills 100 can adjust speed and/or inclination at identical times of the routines. The users 12 can be presented with information on their relative performances as part of the simulation. Such information can include, for example, a relative location of the users 12 on the simulated course. In this manner, the users 12 can experience a competitive environment while utilizing the treadmill 100. In an embodiment, the treadmill 100 also can record a user's 12 performance in a routine, such as a simulated course, and present information to a user 12 (the same user or another individual) as the user 12 is utilizing the routine. The previous performance may have been performed on the same or a different treadmill 100. In this manner, a user 12 can race against another user, the user's best time, and/or the like, while performing the routine.

While various aspects of the invention have been described in conjunction with a treadmill used for running, it is understood that aspects of the invention can be directed to other embodiments. For example, the treadmill can be utilized for walking, jogging, and/or the like, which can be performed for enjoyment by the individual, as part of a formal training regimen, and/or as part of a medical evaluation. Embodiments also can be directed to other forms of exercise. For example, an embodiment of the treadmill described herein can be configured to allow a bicycle to be peddled. To this extent, the treadmill can be configured with rollers at the front and rear of the platform, which have a circumference and height above the belt to allow a bicycle wheel to roll freely against the rollers. Other types of athletic activities can include simulated cross-country skiing, rowing, and/or the like.

While shown and described herein as a method and system for detecting a position of the user on the treadmill 100, it is understood that aspects of the invention further provide various alternative embodiments. For example, in one embodiment, the invention provides a computer program fixed in at least one computer-readable medium, which when executed, enables a computer system to manage operation of the treadmill 100 using a process described herein. To this extent, the computer-readable medium includes program code, such as the management program 30 (FIG. 12), which enables a computer system to implement some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; and/or the like.

In another embodiment, the invention provides a method of providing a copy of program code, such as the management program 30 (FIG. 12), which enables a computer system to implement some or all of a process described herein. In this case, a computer system can process a copy of the program code to generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of the program code, which includes a computer system receiving the set of data signals described herein, and translating the set of data signals into a copy of the computer program fixed in at least one computer-readable medium. In either case, the set of data signals can be transmitted/received using any type of communications link.

In still another embodiment, the invention provides a method of generating a system for managing operation of a treadmill 100 as described herein. In this case, the generating can include configuring a computer system, such as the computer system 20 (FIG. 12), to implement a method of managing operation of the treadmill 100 described herein. The configuring can include obtaining (e.g., creating, maintaining, purchasing, modifying, using, making available, etc.) one or more hardware components, with or without one or more software modules, and setting up the components and/or modules to implement a process described herein. To this extent, the configuring can include deploying one or more components to the computer system, which can comprise one or more of: (1) installing program code on a computing device; (2) adding one or more computing and/or I/O devices to the computer system; (3) incorporating and/or modifying the computer system to enable it to perform a process described herein; and/or the like.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A treadmill comprising:

a platform;

a belt configured to rotate around the platform to create an endless surface on which a user exercises;

a set of sensors configured to acquire data corresponding to a lengthwise position of the user along a length of a usable surface of the platform;

a user control configured to be at least one of: worn by the user, held by the user, or attached to clothing of the user; and a computer system configured to receive input from the user control, the input including a request to adjust at least one of: rotation of the belt or a resistance of rotation of the belt, and dynamically adjust the at least one of: the rotation of the belt or the resistance of rotation of the belt, in response to the input from the user control and based on the lengthwise position of the user.

2. The treadmill of claim 1, wherein the user control detects user commands via gestures made by the user.

3. The treadmill of claim 1, wherein the computer system receives the input from the user control via a wireless communications solution.

4. The treadmill of claim 1, wherein the computer system is further configured to provide feedback to the user regarding the lengthwise position of the user relative to a target lengthwise area.

5. The treadmill of claim 4, wherein the feedback is provided to the user by a virtual reality system.

6. The treadmill of claim 1, wherein the input from the user control further includes a request to adjust an incline of the platform, and wherein the computer system is further configured to dynamically adjust the incline of the platform in response to the input from the user control and based on the lengthwise position of the user.

7. The treadmill of claim 1, wherein the computer system is further configured to dynamically adjust an incline of the platform according to a predetermined exercise routine.

8. The treadmill of claim 1, wherein the computer system is further configured to receive simulation input from a computer executing a simulation for the user and dynamically adjust at least one of: the rotation of the belt, the resistance of rotation of the belt, or an incline of the platform, based on the simulation input.

9. The treadmill of claim 1, wherein the computer system is further configured to decrease or stop the rotation of the belt in response to the lengthwise position of the user being outside the usable surface of the platform.

10. A treadmill comprising:

a platform;

a belt configured to rotate around the platform to create an endless surface on which a user exercises;

a set of sensors configured to acquire data corresponding to at least one of: a lengthwise position of the user along a length of a usable surface of the platform or a lateral position of the user on the belt; and a computer system configured to trigger a set of actions based on the data corresponding to the at least one of: the lengthwise position of the user on the platform or the lateral position of the user on the belt, wherein the set of actions include providing feedback to the user regarding the at least one of: the lengthwise position of the user on the platform relative to a target lengthwise area or the lateral position of the user on the belt relative to a target lateral area.

11. The treadmill of claim 10, wherein the feedback is visual and/or auditory feedback.

12. The treadmill of claim 10, wherein the set of actions further include dynamically adjusting at least one of: rotation of the belt, a resistance of rotation of the belt, or an incline of platform.

13. The treadmill of claim 10, wherein the computer system is further configured to receive input from a control device and trigger at least one action based on the data corresponding to the at least one of: the lengthwise position of the user on the platform or the lateral position of the user on the belt, and the input from the control device.

14. The treadmill of claim 13, wherein the control device is a user control configured to be at least one of: worn by the user, held by the user, or attached to clothing of the user.

15. The treadmill of claim 13, wherein the control device is a computer executing a simulation for the user.

16. The treadmill of claim 10, wherein the computer system is further configured to dynamically adjust at least one of: rotation of the belt, an incline of the platform, or a resistance of rotation of the belt, according to a predetermined exercise routine.

17. The treadmill of claim 10, wherein the set of actions include, in response to determining that the user is outside of the target lengthwise area, reducing a speed of rotation of the belt to zero.

18. The treadmill of claim 10, further comprising a ramp covering a back end of the platform.

* * * * *